US005833380A

United States Patent [19]

Hosomi et al.

[11] Patent Number: 5,833,380

[45] Date of Patent: Nov. 10, 1998

[54] PRINTER HAVING CUTTING APPARATUS AND PROTECTIVE DEVICE FOR USE IN A PRINTER

[75] Inventors: Hiroaki Hosomi; Akio Nomura; Toru Takami; Satoshi Nakajima; Yoshiharu Matsumoto, all of Suwa, Japan

[73] Assignee: Seiko Epson Corporation, Tokyo, Japan

[21] Appl. No.: 752,782

[22] Filed: Nov. 20, 1996

[30] Foreign Application Priority Data

| | | | |
|---|---|---|---|
| Nov. 21, 1995 | [JP] | Japan | 7-303144 |
| Jun. 11, 1996 | [JP] | Japan | 8-149600 |

[51] Int. Cl.[6] ..... B41J 11/66

[52] U.S. Cl. ..... 400/621; 346/24; 101/93.07; 83/563; 83/564; 83/568

[58] Field of Search ..... 400/621; 101/93.07; 346/24; 83/542, 563, 564, 568

[56] References Cited

U.S. PATENT DOCUMENTS

| | | | |
|---|---|---|---|
| 4,302,119 | 11/1981 | Siegenthaler | 400/621 |
| 4,451,167 | 5/1984 | Honma et al. | 400/621 |
| 4,544,293 | 10/1985 | Cranston et al. | 400/621 |
| 5,447,383 | 9/1995 | Hirono et al. | 400/621 |
| 5,482,389 | 1/1996 | Bickoff et al. | 400/621 |
| 5,524,996 | 6/1996 | Carpenter et al. | 400/621 |
| 5,613,788 | 3/1997 | Dobring | 400/621 |

FOREIGN PATENT DOCUMENTS

| | | |
|---|---|---|
| 0 068 621 | 1/1983 | European Pat. Off. . |
| 0 634 278 | 1/1995 | European Pat. Off. . |
| 0 655 031 | 8/1996 | European Pat. Off. . |
| 2 697 776 | 5/1994 | France . |
| 57-30066 | 7/1982 | Japan . |
| 60-019569 | 1/1985 | Japan . |
| 6-238970 | 8/1994 | Japan . |
| 7-11996 | 3/1995 | Japan . |
| 72-90780 | 11/1995 | Japan . |

*Primary Examiner*—Eugene H. Eickholt
*Attorney, Agent, or Firm*—Mark P. Watson

[57] ABSTRACT

A printer comprising a cutting device for cutting the recording paper with a clean, straight edge is achieved. The printer comprises a pair of separable cutting blades, a fixed blade 14 and a movable blade 9, disposed with the cutting edges thereof mutually opposed in a substantially facing relationship on opposite sides of the paper exit 15 from which the recording paper is ejected. The movable blade 9 contacts fixed blade 14 at a point, and is driven with a scissors-like sliding action across fixed blade 14 by means of movable blade drive 10. Fixed blade 14 is supported on an openable cover frame 8 by support member 16 with a certain amount of play. Movable blade 9 is housed inside cutter unit frame 11. The cover frame supporting the fixed blade can be displaced between a cutting position wherein the fixed blade and the movable blade are disposed in an adjacent, substantially facing relationship and a non-cutting position wherein the fixed blade and movable blade are disposed at a distance from one another.

12 Claims, 23 Drawing Sheets

PRINTER HAVING CUTTING APPARATUS AND PROTECTIVE DEVICE FOR USE IN A PRINTER

BACKGROUND OF THE INVENTION

1. Field of the Invention

The present invention relates to a printer used, for example, with electronic cash registers included in point-of-sale (POS) systems, and relates particularly to a printer having a cutter for automatically cutting the recording medium on which the printer prints.

2. Description of the Related Art

Printers used in point-of-sale (POS) systems generally print on rolled recording paper as the recording medium using a thermal head or other type of print head, and include a cutter to cut the printed recording paper to create a sales receipt that can be handed to the customer.

Typical of the various cutters employed in such printers are cutters that cut the recording paper by pushing a cutting blade perpendicularly against the recording paper as described in Japanese patent laid-open number JP-H6-238970 (1994-238970), and cutters that cut the recording paper using a fixed blade and a movable blade as described in Japanese utility patent laid-open number JP-S54-123482 (1979-123482).

A scissors cutter that cuts the recording paper by moving the movable blade across the recording paper while cutting the recording paper from one edge to the other is also known as described in Japanese utility patent laid-open number JP-H2-10953 (1990-10953).

The problems that arise with printers of these types are described below.

Specifically, when the recording paper is cut by means of pushing a serrated knife edge perpendicularly against the recording paper, a great drive force is required because the paper is cut after the plural serrations of the cutting edge pierce the recording paper, and the cut edge of the recording paper is not particularly clean. This process thus produces paper chaff from the cutting process. The cutting blade also tends to chatter from the impact of the blade when cutting the recording paper, making it difficult to achieve a straight cut edge.

Problems with an uneven paper feed pitch also occur both with cutters that cut by pushing a cutting blade perpendicularly against the recording paper, and with cutters that cut the recording paper using a fixed blade and movable blade combination. This is because both of these cutters pull the recording paper on the upstream side of the cutting position during the cutting operation.

The fixed blade and movable blade of a scissors-type cutter are coupled together by a common support pin because a change in the relative positions of the fixed blade and movable blade produces a poor cut edge. This makes it necessary when paper is loaded to the printer to insert the paper between the fixed blade and movable blade, and this can be an awkward or difficult task.

The sliding action of the movable blade across the fixed blade in scissors-type cutting apparatus also creates problems with the service life of the cutting blades and it is not easy to change the blades.

When operation is interrupted while cutting the recording paper with this type of apparatus, it is desirable to return smoothly to the current paper position when operation is resumed.

It is also necessary to open the printer cover with this type of printer to change the recording paper. As a result, it is dangerous to have the cutting blades exposed when the cover is open.

It is also common in this type of printer for part of the paper transport path to be disposed within the operating part of the printer cover. The construction of the cutter tends to become complicated in such applications, however, if a cutter with a sharp cutting edge is provided.

OBJECTS OF THE INVENTION

The object of the present invention is therefore to provide a printer to resolve the problems of the prior art as described above, and to specifically provide a printer comprising a cutting means that produces a clean cut edge on the recording paper, excellent linearity (straightness) in the cut edge of the recording paper, and uniform cutting quality at all parts of the cutting blade.

A further object of the invention is to provide a printer comprising a cutting means having excellent durability and excellent ease of use when the printer stops abnormally and when the blades are replaced.

A further object of the invention is to provide a printer comprising a cutting means that has a high degree of design freedom, is safe to handle, and has a simple construction.

Still a further object of the invention is to provide a protective device capable of preventing an exposed cutting edge of a cutting blade in a printer from being accidentally touched by a user.

SUMMARY OF THE INVENTION

The fixed blade and movable blade that engage with a sliding action to cut the recording paper are each supported independently of the other in a printer according to the present invention. The blade support means enables one of the blades to be separated at a distance from the other in a non-cutting position. The recording medium can be easily loaded and set between the blades when the blades are thus separated using the blade support means, and the operability of the printer is thus improved.

The fixed blade and movable blade cut the recording medium by means of a sliding engagement. The cut edge does not become wavy because there is no impact against the recording medium during cutting, and the cut edge is therefore good. Moreover, because no force in the direction of recording medium transportation acts on the recording medium, the recording medium is not pulled out, there is excellent linearity in the cut edge, the paper feed pitch precision improves, and print quality thus also improves.

The blade support means preferably comprises a cover member mounted to a main frame and supporting one of the two blades. The main frame defines a compartment for the recording medium. The cover member is mounted so as to be rotatable between an opened and a closed state. When the cover member is in its opened state it exposes the compartment for the recording medium. It is therefore possible by simply placing the recording medium in the compartment and closing the cover to set the recording medium between the fixed blade and movable blade. It is thus simple to replace the recording medium, and operability is improved.

A contact member that can be contacted by the fixed blade is further disposed on the support member supporting the movable blade in a pivotable manner. This forms a positioning mechanism whereby the sliding surface of the fixed blade and the sliding surface of the movable blade are positioned on substantially the same plane in substantially facing relationship when the fixed blade contacts the contact member in the cutting position. It is therefore possible to ensure that the fixed blade and movable blade can be engaged with a sliding scissors action when the fixed blade contacts the contact member. Problems such as the movable blade striking the fixed blade, or failure to cut the recording medium because the blades do not engage, therefore do not occur, and a good cutting edge can be maintained whether the cover is open or closed.

By further providing an engaging means that engages the blade support means in the cutting position, movement of the blade support means is limited by said engaging means even if an external force causing the blade support means to separate acts thereon during cutting. By thus preventing the relative positions of the fixed blade and movable blade from changing, a good cutting edge can be maintained.

The blade support means is also configured such that when the blade supported on the blade support means is separated from the cutting position the direction of the relative movement between the fixed blade and movable blade at the beginning of this separation is substantially the same as the direction the movable blade travels when cutting the recording medium. As a result, even if operation stops during cutting with the movable blade engaged with the fixed blade, the blade support means can be rotated open to smoothly separate the cutting edge of the fixed blade from the cutting edge of the movable blade, and the mechanical parts around the fixed blade and movable blade will not be damaged.

By providing the blade cover member of the printer according to the present invention with an operating mechanism whereby the blade cover member retracts from the transport path of the recording medium and the cutting edge of the cutting apparatus when in the cutting position, and pivots from this retracted position to cover the cutting edge of the cutting blade when the cutting apparatus is opened, operator safety can be improved when the blade support means is opened because the operator cannot accidentally touch the cutting edge of the blade.

Other objects and attainments together with a fuller understanding of the invention will become apparent and appreciated by referring to the following description and claims taken in conjunction with the accompanying drawings.

BRIEF DESCRIPTION OF THE DRAWINGS

The present invention will become more fully understood from the detailed description given below and the accompanying diagrams wherein.

DESCRIPTION OF THE PREFERRED EMBODIMENTS

The preferred embodiments of a printer according to the present invention are described below with reference to the accompanying FIG. 1 to FIG. 24.

Figure 3:
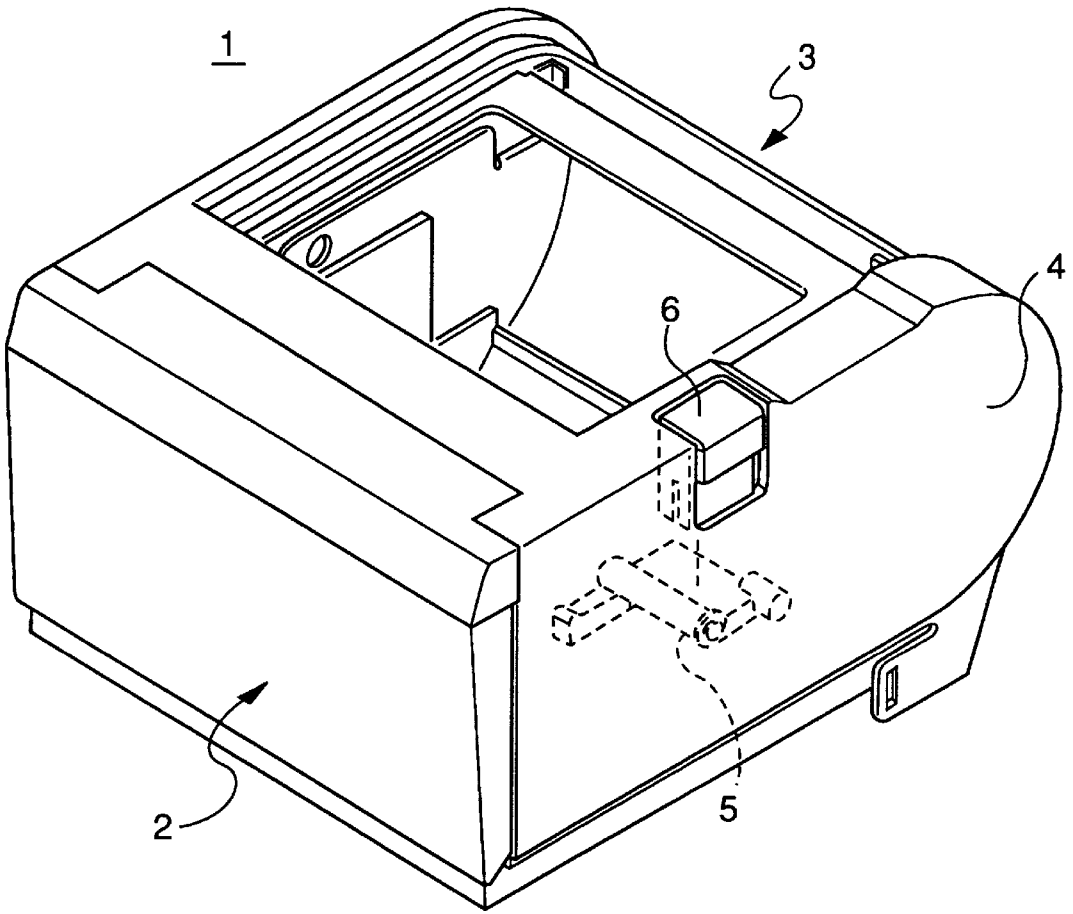
FIG. 3 is a perspective view of the exterior configuration of the printer according to the present invention with the top cover of the printer removed.

FIG. 3 is a perspective view of the exterior configuration of the printer according to a first embodiment of the present invention. Printer 1 comprises a case 4 made of plastic resin and having a front panel 2 and a top cover which is not shown. In its rear part the printer 1 has a compartment 3 for accommodating a paper roll. A button 6 disposed on the right side of the compartment 3 in the case 4 serves to drive a lever 5 by which a cover frame 8 can be rotated to an opened position as will be explained in more detail hereinafter.

Figure 1:
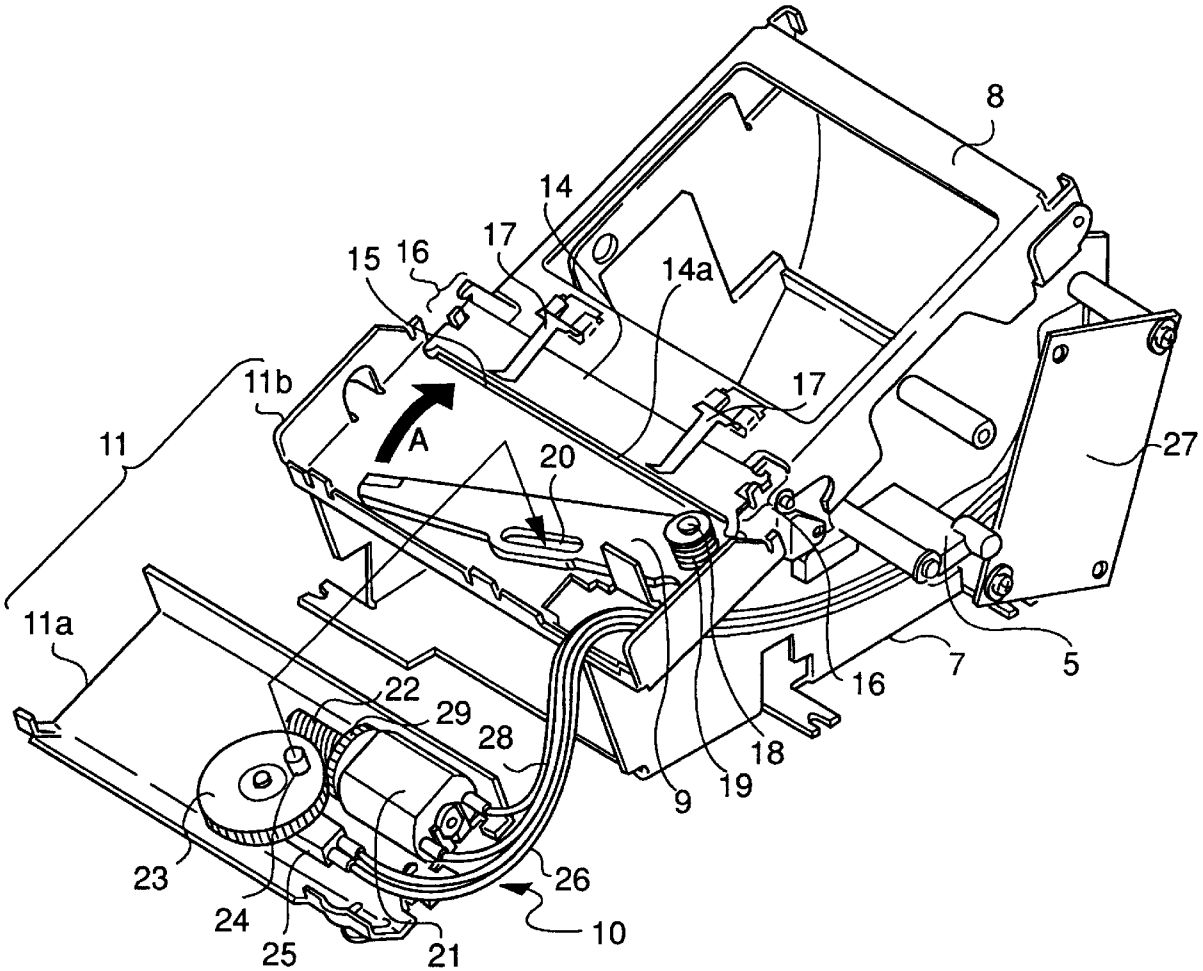
FIG. 1 is an elevational view showing the internal structure of the printer 1 according to the present invention with the cover of the cutter unit frame open.
Figure 2:
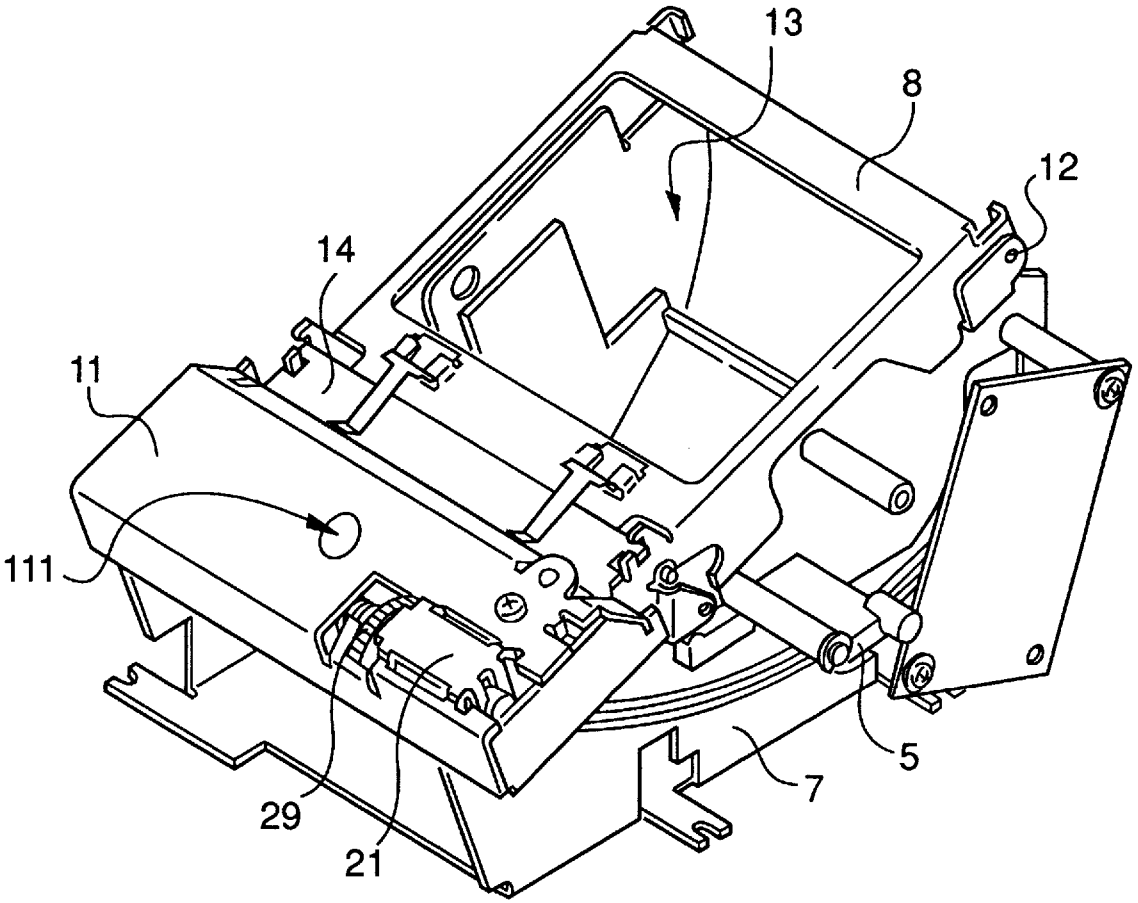
FIG. 2 is a perspective view showing the internal structure of the printer 1 according to the present invention with the cover of the cutter unit frame closed.

FIGS. 1, 2, 4 and 5 show various views of printer 1 illustrating the internal structure of the printer. At its rear end, the cover frame 8 is pivotally supported on a main frame 7 by means of studs 12 disposed at both sides on an upper rear part of the main frame 7. Main frame 7 is made, for example, from a thin metal sheet. The cover frame 8 is pivotable between an opened position shown in FIG. 5 and a closed position shown in FIG. 4. As is best shown in FIGS. 1 and 2, cover frame 8 has a square shaped window 13 into which an upper part of the roll of paper S enters when cover frame 8 is rotated to its closed position, thereby avoiding interference between cover frame 8 and the paper roll. Note that while reference is made to paper as the recording medium in this specification, any other suitable recording medium may be used instead.

Figure 4:
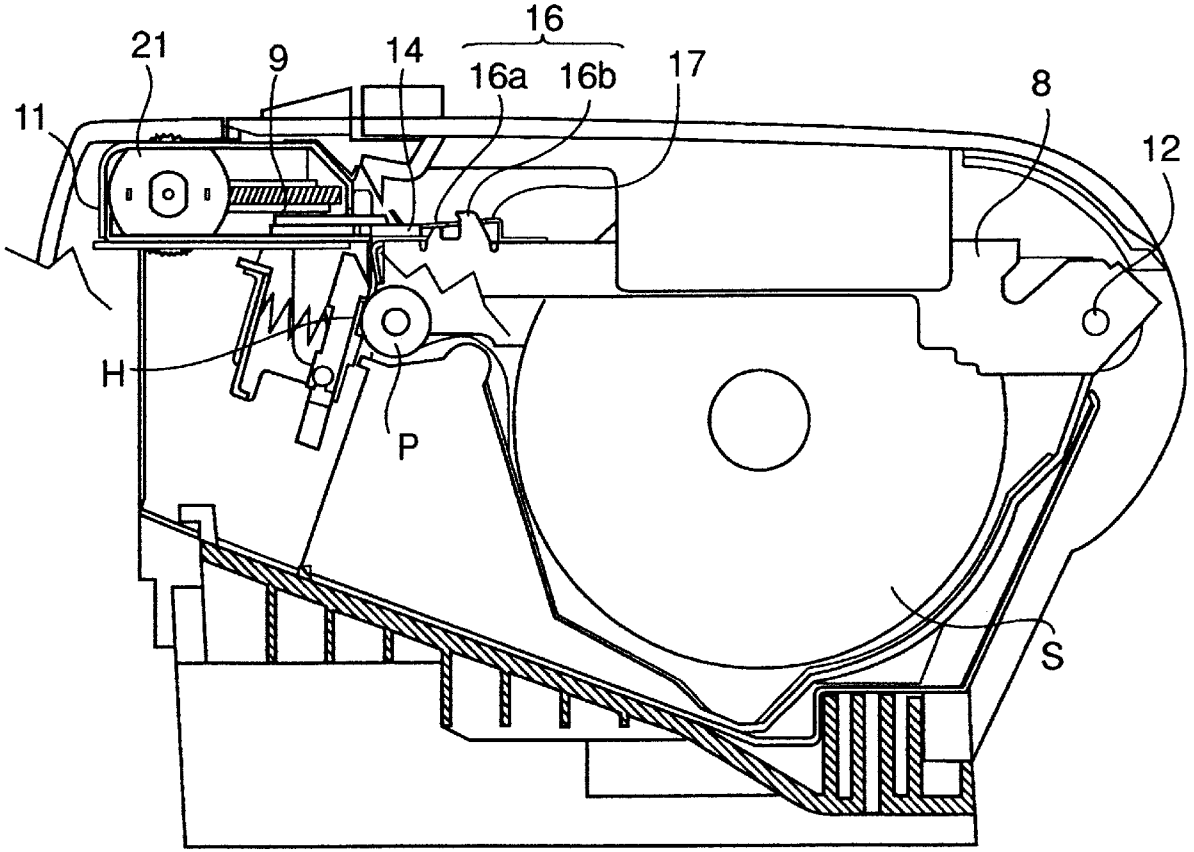
FIG. 4 is a side view showing the major components of the above embodiment with the cover frame closed.
Figure 5:
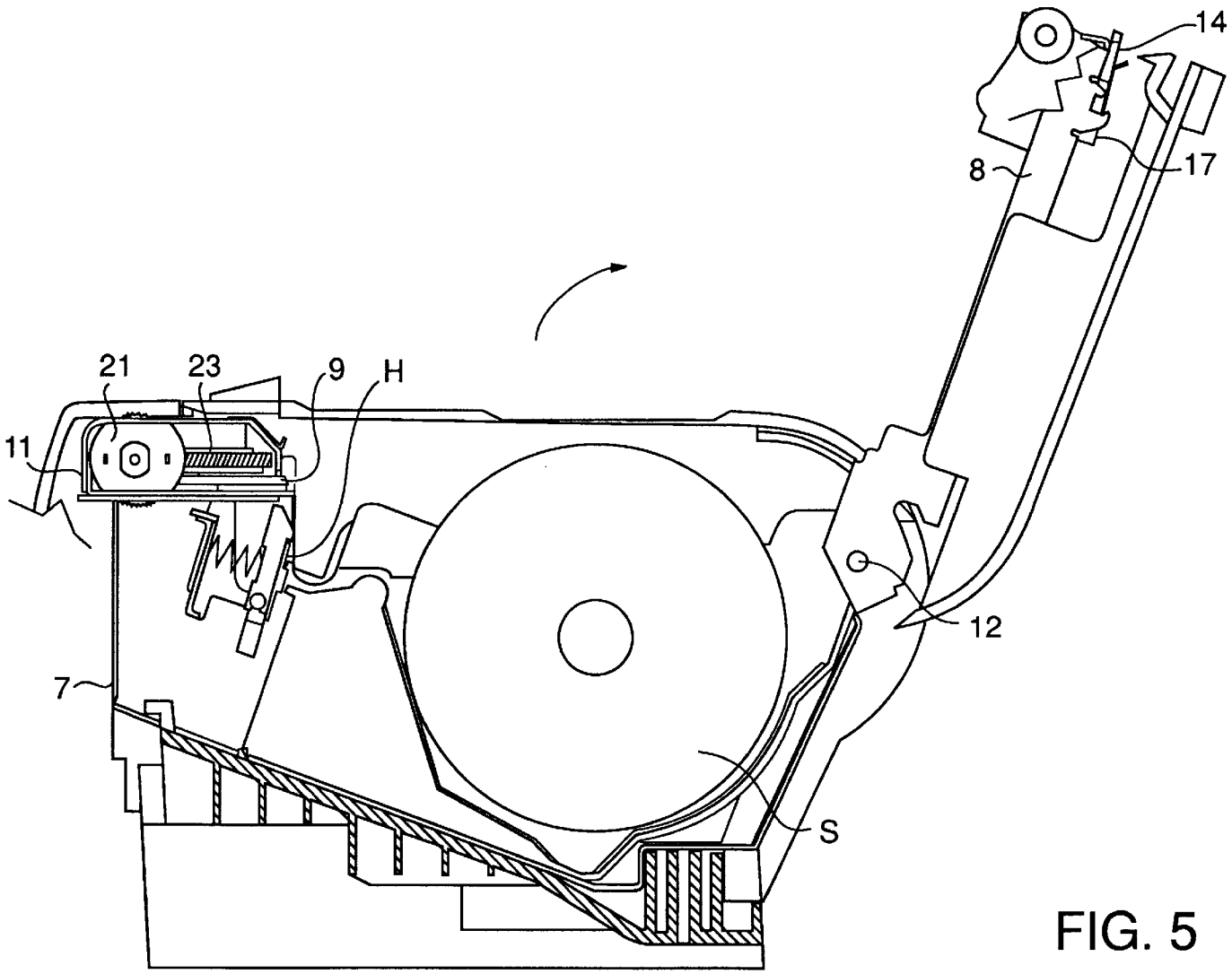
FIG. 5 is a side view showing the major components of the above embodiment with the cover frame open.

As is best shown in FIG. 4, paper from the paper roll is guided along a paper path to a print unit arranged in a front part of the printer 1. The print unit includes a print head H, such as a thermal print head, and a platen roller P. The paper is printed in a conventional manner as it passes through the print unit in between print head H and the platen roller P. Having passed the print unit the paper is fed to a cutter disposed above the print unit.

As shown in FIG. 1, the cutter comprises a fixed blade 14 mounted on cover frame 8 and a movable blade 9 mounted on a lower frame part 11*b* of a cutter frame 11. The cutter frame 11 is mounted on main frame 7 adjacent to the front end of the cover frame 8 and is composed of lower frame part 11*b* and an upper frame part 11*a*. FIG. 1 shows frame parts 11*a* and 11*b* separated from each other and the frame part 11*a* turned upside down. FIG. 2 shows the cutter frame 11 with the frame parts 11*a* and 11*b* assembled. With this structure, when the cover frame 8 is turned to its opened position, the fixed blade 14 and movable blade 9 are separated at a distance from each other; conversely, when the cover frame 8 is in its closed position the fixed blade 14 and movable blade 9 are arranged in a substantially facing relationship to cooperate for cutting the paper.

As shown in FIG. 1, the fixed blade 14 is disposed at the front end of the cover frame 8. The fixed blade 14 may be manufactured, for example, from a rectangular metal plate member. The fixed blade 14 is disposed with its cutting edge 14*a* facing the cutter frame 11. A slit-like paper exit 15 of the paper path through which paper S is transported and ejected is formed between the cutting edge 14*a* of the fixed blade 14 and lower frame part 11*b*.

Figure 8:
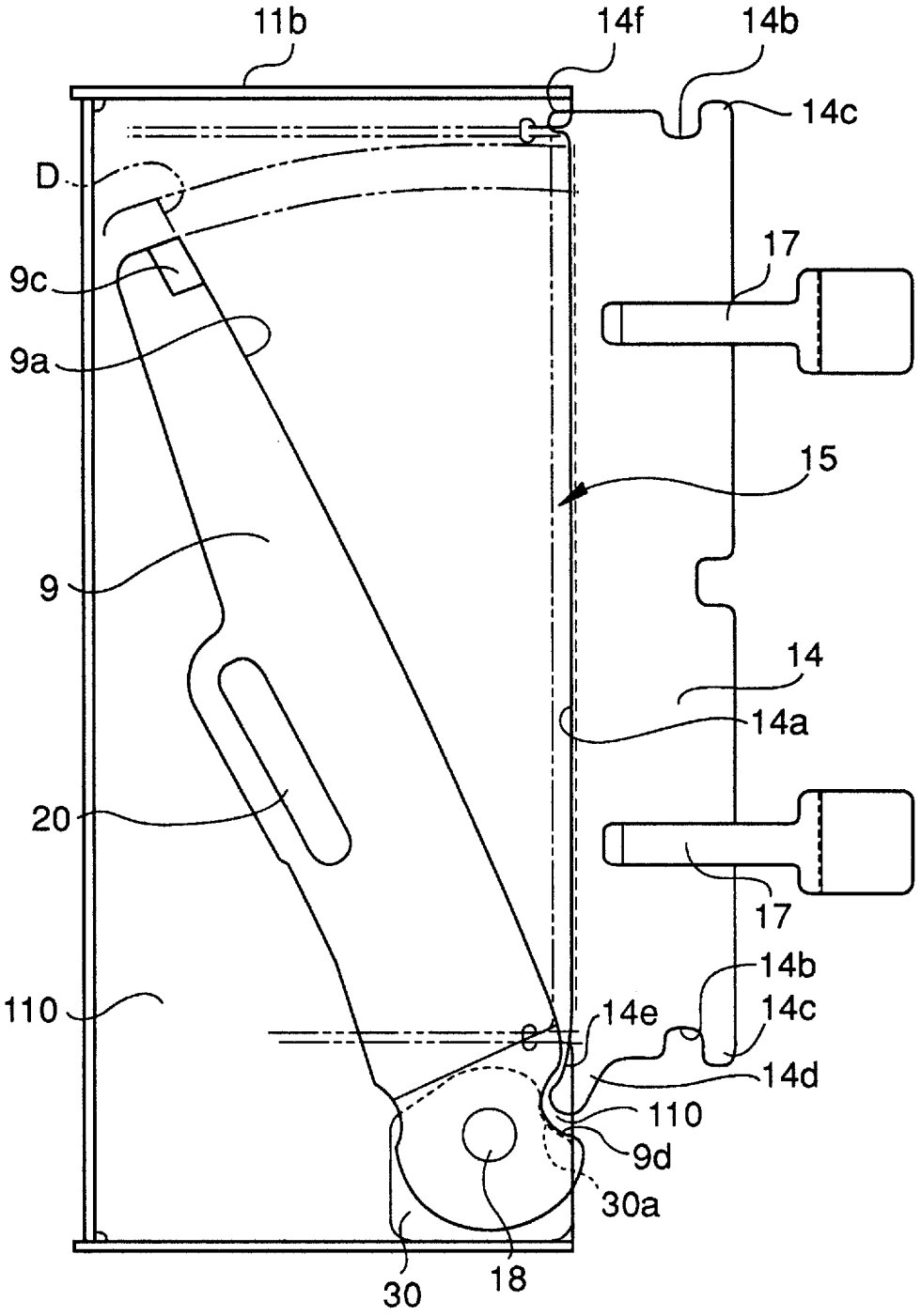
FIG. 8 is a plan view showing the area around the fixed blade and the movable blade of the printer according to the present embodiment.

As shown in FIG. 8, a recess 14*b* and a tab 14*c* are formed at each lateral end of fixed blade 14 for engagement with respective support members 16 (FIGS. 1 and 4), which are disposed at corresponding positions on both sides of cover frame 8. As shown in FIG. 1, fixed blade 14 is pressed from above toward the surface of cover frame 8 by means of two press-springs 17 fastened to the top of cover frame 8. Because fixed blade 14 is pressed downward by movable blade 9 at the start of each cut, as will be explained later, the pressure applied by springs 17 does not need to be particularly great. In addition, because the cutting quality is not greatly affected by the pressure applied by springs 17, this pressure only needs to be strong enough to prevent fixed blade 14 from coming off cover frame 8.

As shown in FIG. 4, each support member 16 is substantially U-shaped. The open end of the U-shape is up. With reference to FIGS. 1 and 4, one leg of the U-shape, which faces the printer's rear side forms a rear tab 16*b* and the other leg facing the printer's front side forms a front tab 16*a*. Rear tab 16*b* is higher than front tab 16*a*. When cover frame 8 is closed, the blade side of fixed blade 14 rides up on bottom 110 of lower frame 11*b* (FIG. 8), and is thereby raised slightly from cover frame 8 to create a gap between the cutting edge 14*a* and the cover frame 8.

Movable blade 9 for cutting the recording paper S in conjunction with fixed blade 14 is also disposed on bottom 110 of lower frame part 11*b*. In the present embodiment movable blade 9 is rotatably mounted on, for example, a stud 18 disposed at one end of cutter unit frame 11 to allow movable blade 9 to rotate freely in the direction of arrow A in FIG. 1 or in the opposite direction. Movable blade 9 is biased against bottom 110 of lower frame part 11*b* by means of coil spring 19. Coil spring 19 is fit around stud 18 and is secured at the top thereof by a push nut pressed onto stud 18. An elongated hole 20 is disposed at substantially the center of movable blade 9 for receiving a crank pin 24 for driving movable blade 9.

Drive mechanism 10 for driving movable blade 9 is positioned beneath upper frame part 11*a* of cutter unit frame 11 as also shown in FIG. 1. The drive mechanism comprises a drive motor 21 mounted beneath cover 11*a*, a worm gear 22 fastened to the rotating shaft of the drive motor 21, a worm wheel 23 which is also positioned beneath cover 11*a* for meshing with worm gear 22 and a crank pin 24 fixed to worm wheel 23 and engaging elongated hole 20 of movable blade 9 to drive movable blade 9 in the direction of arrow A and in the opposite direction. A sensor 25 for detecting the angular position of worm wheel 23 is connected to worm wheel 23 and beneath cover 11*a*, and is connected by lead wires 26 to circuit board 27. Drive motor 21 is connected to circuit board 27 by lead wires 28.

Spur gear 29 is formed at the base of worm gear 22, and is exposed through an opening in upper frame part 11*a* of cutter unit frame 11 as shown in FIG. 2. By thus exposing spur gear 29, it is possible to manually turn spur gear 29 to rotate the shaft of drive motor 21 and thus manually move moveable blade 9 without removing upper frame part 11*a* of cutter unit frame 11.

Figure 6:
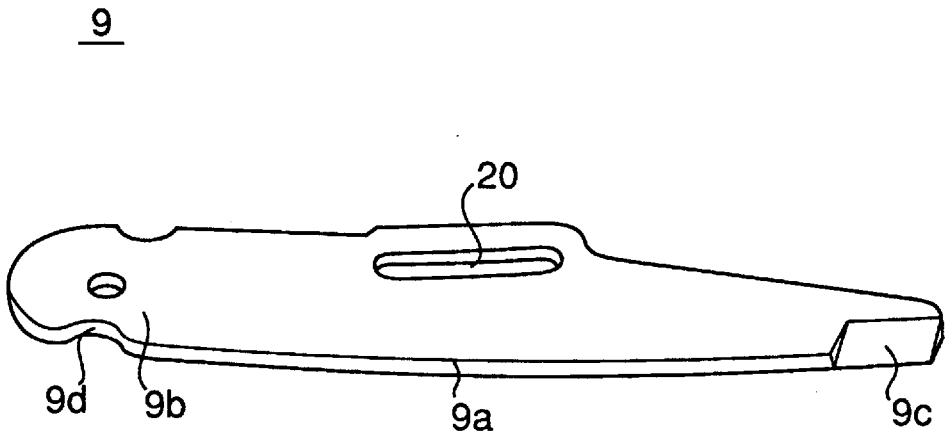
FIG. 6 is a perspective view of the entire movable blade of the above embodiment.
Figure 7A:
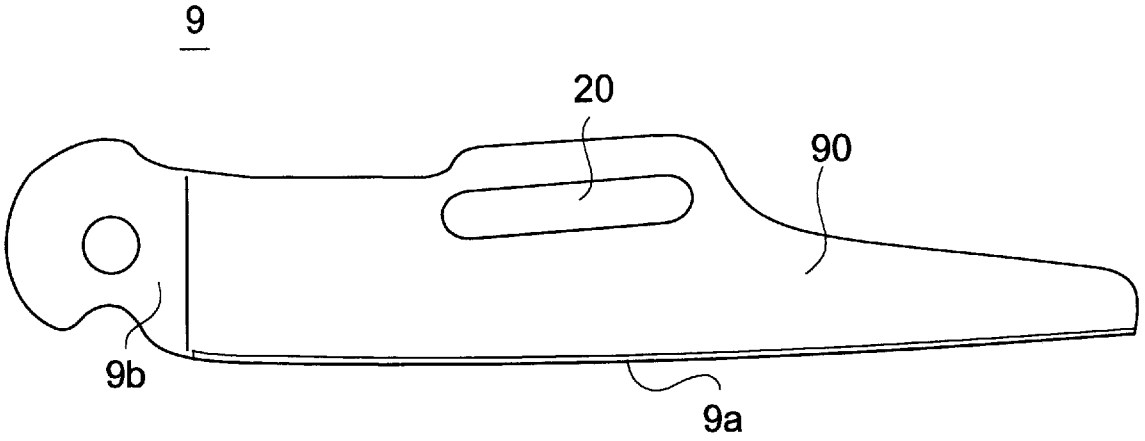
FIG. 7A is a side view of the movable blade of the above embodiment with FIG. 7B showing the angle of curvature of the body of the movable blade.
Figure 7B:
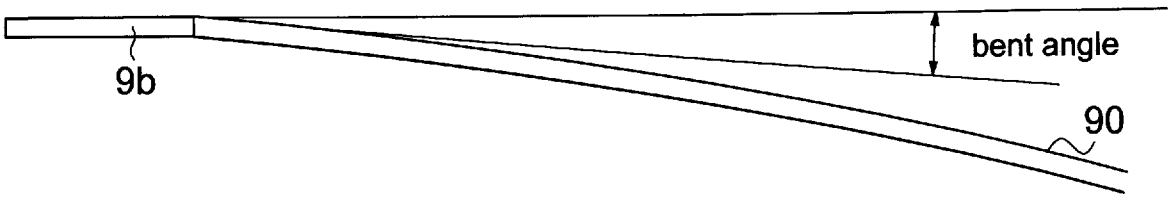

FIG. 6 is a perspective view of movable blade 9, and FIG. 7 shows the bending angle of body 90 of movable blade 9. As shown in FIG. 6, movable blade 9 of the present embodiment is shaped substantially like one of the scissor blades of a conventional scissors-like cutter. More specifically, movable blade 9 is manufactured from a long metal plate member with a cutting edge 9*a* formed on the side facing fixed blade 14. As shown in FIG. 7, body 90 is declined downwardly approximately one degree to the back from mounting member 9*b*. In addition, body 90 of movable blade 9 is formed with a slight arc toward the tip of the blade.

Note that the cutter of the present embodiment does not completely cut the end of recording paper S off and leaves the cut paper end connected to the roll. To prevent the uncut remnant of recording paper S from being torn by the thickness of the end of movable blade 9, a knife tip 9*c* that is thinner than the cutting edge 9*a* is formed at the end of the tip of movable blade 9.

Figure 9:
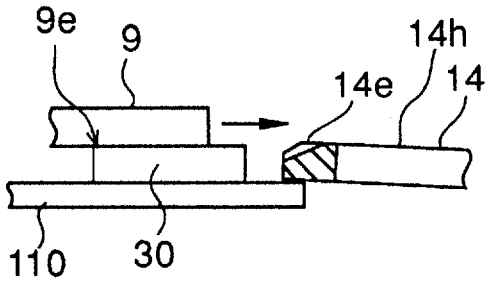
FIG. 9 illustrates the principle whereby the movable blade 9 rides up on the fixed blade 14 in a printer according to the present embodiment.

As also shown in FIG. 8, movable blade 9 is supported on bottom 110, which is a support member therefor, in a manner enabling movable blade 9 to pivot at one end. Tab 14*d* for mating the position of fixed blade 14 with movable blade 9 is formed at the end of fixed blade 14 near movable blade 9 but outside the paper transportation path. Tab 14*d* is formed so that when cover frame 8 is closed tabs 14*d* and 14*f* contact and ride up on the exposed bottom 110 of lower frame 11*b*. To compensate, a support base 30 (spacer) of approximately the same thickness as the fixed blade 14 is also provided, as shown in FIG. 9, as a means of adjusting the height of sliding surface 9*e* of movable blade 9 and sliding surface 14*h* of fixed blade 14 to approximately the same plane. Since the level of bottom 110 is higher than that of the surface of cover frame 8, tabs 14*d* and 14*f* resting on bottom 110 cause fixed blade 14 to be lifted, and a slight gap to be formed between fixed blade 14 and the surface of cover frame 8.

As shown in FIGS. 8 and 9, a chamfer 14*e* for lifting movable blade 9 is also formed on the top of tab 14*d* on the same side of tab 14*d* as the edge of fixed blade 14. Fixed blade 14 therefore always contacts bottom 110 to which movable blade 9 is fastened in a pivotable manner through a support base 30 that is roughly the same thickness as fixed blade 14. As a result of chamfer 14*e*, the effective cutting quality of the blades does not deteriorate because a gap is initially formed between the opposing sliding surfaces of movable blade 9 and fixed blade 14, and movable blade 9 is not prevented from sliding across fixed blade 14 due to excessive engagement between the two blades. Furthermore, by forming a chamfer at the part where the fixed blade and movable blade first contact, the fixed blade and movable blade will slide smoothly in mutual contact when the blades meet. Even if there is a slight offset in the relative positions (alignment) of the fixed blade and movable blade, the impact force when the blades meet will not be strong and the blades will not be damaged. High precision is therefore not required in the parts, and a lower cost can thus be achieved in the finished apparatus.

Note that the tab 14*f* (FIG. 8) is also formed on the edge of fixed blade 14 at the end corresponding to the end of movable blade 9 remote from stud 18. This tab 14*f* is also formed to ride up on bottom 110 of lower frame 11*b* when cover frame 8 is closed, thereby raising the cutting edge of the fixed blade 14 and creating a gap with cover frame 8.

As shown in FIG. 8, the length of movable blade 9 is shorter than the length of cutting edge 14*a* of fixed blade 14 by a certain distance D to prevent cutting completely across recording paper S and thus leaves an uncut piece at the corresponding edge of the paper. To cut completely across the recording paper, the length of the cutting edge is simply made longer to include distance D. In this case it is not necessary to form the movable blade 9 with thin tip 9*c*.

As shown in FIG. 8 and FIG. 9, support base 30 is disposed between movable blade 9 and bottom 110 of lower frame 11*b*. This support base 30 is preferably a flat member of the same thickness as fixed blade 14. In the preferred embodiment of the invention fixed blade 14 and support base 30 are stamped from the same piece of material in a stamping process. The relative positions of the fixed blade and movable blade are thus determined by using a support base of the same thickness as the fixed blade 14. As a result, an excellent cut edge that is as clean as the edge obtained with a conventional scissors-like cutter in which the blades are inseparable and fixed relative to each other can be obtained even though in the present invention the cutting apparatus uses separable blades.

Cut-outs 9*d* and 30*a* are also formed in movable blade 9 and support base 30, respectively, at appropriate positions opposing fixed blade 14. As a result, bottom 110 of lower frame 11*b* is exposed when movable blade 9 is retracted inside cutter unit frame 11 as shown in FIG. 8, the initial angle at which cutting edge 14*a* of fixed blade 14 and cutting edge 9*a* of movable blade 9 cross, i.e., the initial cutting angle, can therefore be increased, and an excellent edge can be achieved in the cut paper.

The operation of printer 1 according to the present embodiment is described as follows, with reference to FIGS. 1, 8 and 9 in which cover frame 8, supporting fixed blade 14, is closed in the cutting position with movable blade 9 and fixed blade 14 in a substantially facing relationship.

When recording paper S is to be cut, drive motor 21 is driven at a selected time after printing the text or other information on the recording paper S. This causes worm gear 22 mounted on the drive shaft of drive motor 21 to rotate, thus driving worm wheel 23 engaged with worm gear 22. Movable blade 9 is thus moved in the direction of arrow A as shown in FIG. 1 by means of the link mechanism comprising crank pin 24 in worm wheel 23 and elongated hole 20 in movable blade 9.

As shown in FIG. 9, support base (spacer) 30 of the same thickness as fixed blade 14 is disposed between movable blade 9 and bottom 110 of lower frame 11*b*, and chamfer 14*e* is formed on tab 14*d* of fixed blade 14. As a result, movable blade 9 rides easily onto and over fixed blade 14.

Figure 10:
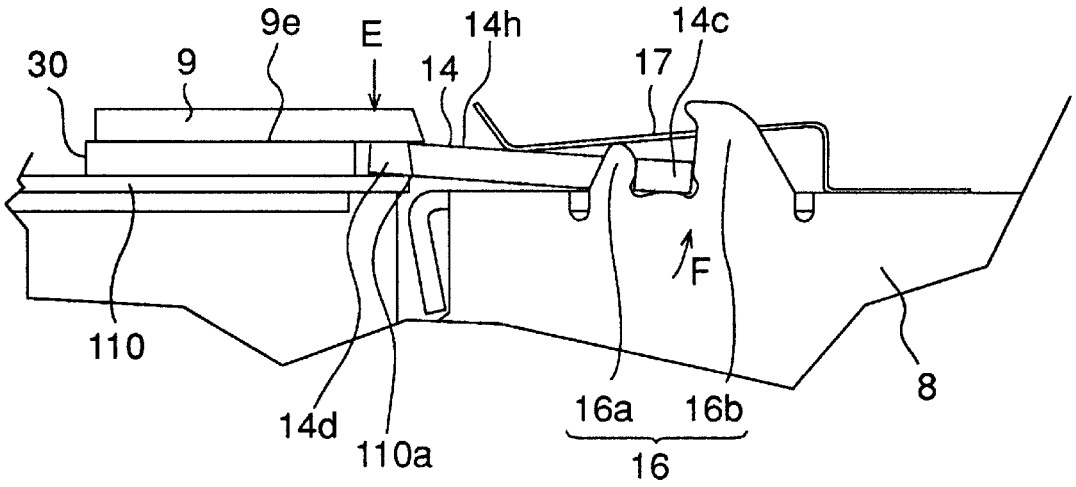
FIG. 10 is a side view showing the relationship between the fixed blade and the movable blade.

Next, the positional relationship between the two blades will be explained. As shown in FIG. 10 fixed blade 14 is pressed toward the bottom 110 such that its tabs 14*d* and 14*f* rest on bottom 110. Because fixed blade 14 is slightly inclined tabs 14*d* and 14*f* contact bottom 110 at its rear edge 110*a* such that a small gap is formed below the portion of the tabs extending forwardly from edge 110*a*. In this state, when movable blade 9 becomes engaged with tab 14*d* of fixed blade 14, a force E is exerted on tab 14*d* causing a moment to be applied to fixed blade 14 in the direction F around edge 110*a* as a fulcrum point. In response to this moment the rear part of fixed blade 14 is raised to rise above cover frame 8 at the portion of support members 16. As a result, sliding face 14*h* of fixed blade 14 is roughly flush with the sliding face 9*e* of movable blade 9 across the whole length of the cutting edge. When movable blade 9 moves, cutting edge 9*a* of movable blade 9 and cutting edge 14*a* of fixed blade 14 therefore remain constantly in contact at one point, and the paper S can be cut smoothly using the same operating principle as a pair of scissors.

Figure 18:
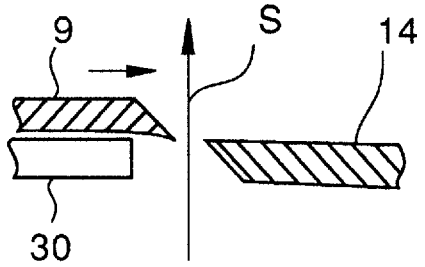
FIGS. 18 and 19 illustrate the way in which the recording medium is cut in a printer according to the present embodiment, FIG. 18 showing the situation before cutting, and FIG. 19 showing the situation after cutting.
Figure 19:
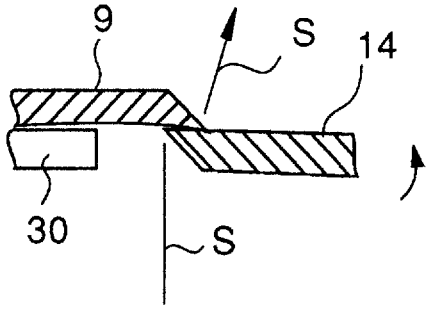

When movable blade 9 moves in the direction of arrow A (FIG. 1), cutting edge 14*a* of fixed blade 14 and cutting edge 9*a* of movable blade 9 contact at a single point because the back of movable blade 9 is concavely shaped. The contact point thus moves gradually toward the tip of movable blade 9 as movable blade 9 continues to be driven. This causes recording paper S to be cut smoothly as shown in FIGS. 18 and 19 as a result of a scissors action. There is also no impact force acting on recording paper S when it is cut, and the linearity (straightness) of the cut edge is thus improved.

More specifically, in the present embodiment the base of movable blade 9 is pressed by coil spring 19 against bottom 110 of lower frame 11*b* and movable blade 9 is pressed against fixed blade 14 with an appropriate force because movable blade 9 is curved slightly in the direction of bottom 110. As a result, recording paper S is cut with an extremely clean edge.

As also shown in FIG. 18 and FIG. 19, fixed blade 14 and movable blade 9 are disposed on the upstream and downstream sides, respectively, in the direction of recording paper S transportation. The position of the uncut recording paper S therefore does not move, and the recording paper S can be smoothly cut without paper jams occurring.

As also shown in FIG. 1 and FIG. 4, the top of the U-shaped support member 16 is open in the present embodiment, and a slight gap is formed below fixed blade 14. When movable blade 9 moves, cutting edge 9*a* of movable blade 9 and cutting edge 14*a* of fixed blade 14 therefore remain constantly in contact at one point, and the recording paper S can be cut smoothly using the same operating principle as a pair of scissors.

Fixed blade 14 is pressed with a weak force by press-springs 17 and is supported with some vertical play, i.e., tolerance for slight vertical movement, relative to support member 16. When movable blade 9 moves, the part of fixed blade 14 supported by support member 16 rises slightly upward as shown by the curved arrow in FIG. 19, cutting edge 9*a* of movable blade 9 and cutting edge 14*a* of fixed blade 14 contact in an optimum condition, and the recording paper S can therefore be cut without curvature in the cut line and without pulling on recording paper S.

Moreover, as shown in FIG. 1 and FIG. 4, the top of the U-shaped support member 16 is open in the present embodiment, and is formed with the support tab 16*b* toward the rear of the printer higher than the support tab 16*a* toward the front of the printer and with support tab 16*b* projecting toward the movable blade. As a result, fixed blade 14 can be moved toward the front of the printer as it is pushed up, and can therefore be removed with a simple operation. When installing fixed blade 14 in the printer, fixed blade 14 contacts support tab 16*b* as it is moved rearwardly toward support tab 16*b*, is guided downward by the bevel formed on the leading edge of support tab 16*b*, and the positioning recesses 14*b* and tabs 14*c* are thereby fit with support member 16. Fixed blade 14 can thus be easily installed in and removed from printer 1, and the blade can be replaced in a short time if the blade is chipped or worn.

Furthermore, because the length of movable blade 9 is set shorter than the length of cutting edge 14*a* of fixed blade 14 as shown in FIG. 8, recording paper S is not cut completely across and can be ejected while still partially connected to the roll. To prevent this, a knife tip 9*c* that is sharper than the cutting edge 9*a*, which is in the main middle section of movable blade 9, is formed at the leading tip of movable blade 9, thereby enabling recording paper S to be cut cleanly without tearing.

It should be noted that if drive motor 21 is driven further after the cutting of recording paper S is completed, the linkage mechanism formed by crank pin 24 of worm wheel 23 and elongated hole 20 of movable blade 9 drives movable blade 9 in the direction opposite the direction of arrow A in FIG. 1, and again stores movable blade 9 inside cutter unit frame 11. Drive motor 21 is further controlled to stop operating when movable blade 9 is detected to have returned to the home position by means of sensor 25 detecting the angle of rotation or worm wheel 23.

The basic configuration and operation of the preferred embodiment of the present invention have been described above. Alternative embodiments of selected parts of the above embodiment and the operational effects thereof are described further below.

As shown in FIG. 7, body 90 curves toward the back approximately one degree (exaggerated in the figure for illustration) relative to mounting member 9*b* in the present embodiment, but may be also comprised such that movable blade 9 is further biased toward fixed blade 14.

More specifically, it is necessary in a scissors-type cutting apparatus for a single point of contact to be maintained between the cutting edges, which cut the paper by means of relative movement between the two edges. Movable blade 9 is therefore shaped with a slight arc from near the base to the tip. At the part of movable blade 9 near stud 18 where cutting starts, however, the curvature of body 90 is very slight and an appropriate contact point between cutting edge 9*a* and cutting edge 14*a* cannot be assured. Body 90 of movable blade 9 is therefore forcibly sloped as described below to assure this contact point with cutting edge 14*a* of fixed blade 14.

Figure 11A:
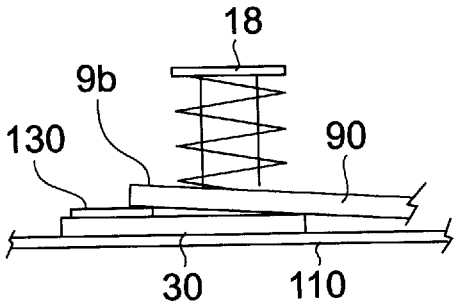
FIGS. 11A, 11B and 11C show various means for inclining the body of the movable blade in a printer according to the present embodiment.
Figure 11B:
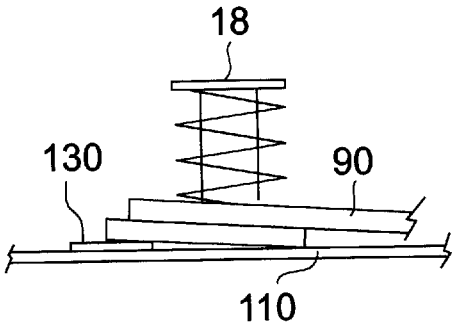

FIG. 11 and FIG. 12 illustrate the means for sloping body 90 of movable blade 9 as described above. A spacer 130 is disposed between support base 30 and mounting member 9*b* of movable blade 9 as shown in FIG. 11A as one means of sloping movable blade 9. As shown in FIG. 11B, the spacer 130 may also be provided between support base 30 and bottom 110 of lower frame 11*b* of cutter unit frame 11.

Figure 12A:
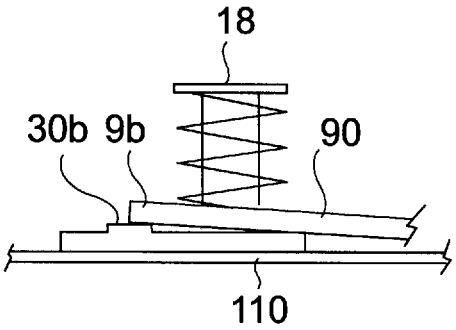
FIGS. 12A, 12B and 12C show various additional means for inclining the body of the movable blade in a printer according to the present embodiment.
Figure 12B:
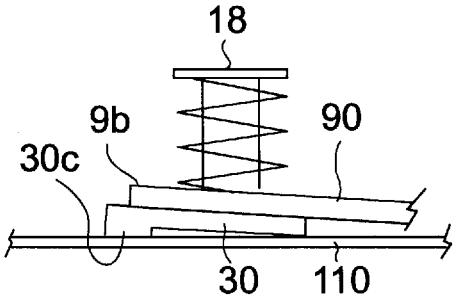

Sloping of movable blade 9 can be accomplished alternatively by providing a shoulder 30*b* on the top surface of support base 30 as shown in FIG. 12A, or by providing a foot 30*c* on the bottom surface of support base 30 as shown in FIG. 12B.

Figure 11C:
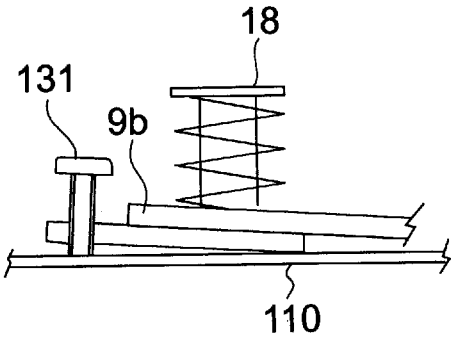
Figure 12C:
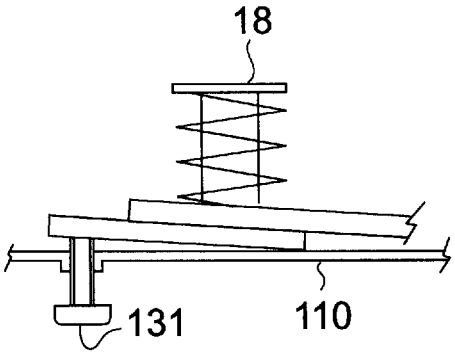

As shown in FIG. 11C and FIG. 12C, it is also possible to provide a screw 131 in support base 30 to raise one edge of support base 30 from bottom 110 of lower frame 11*b*. With this configuration the height of the cutting edge of movable blade 9, or more specifically the contact between cutting edge 9*a* of movable blade 9 and cutting edge 14*a* of fixed blade 14, can be optimally adjusted.

By thus both arcing body 90 of movable blade 9 and inclining movable blade 9, contact at a single point between cutting edge 9*a* of movable blade 9 and cutting edge 14*a* of fixed blade 14 can be assured even where there is little curvature in body 90 at the cutting start position near stud 18, and the straightness and the edge of the cut made by movable blade 9 and fixed blade 14 can be improved.

Note further that if the angle of support base 30 is made adjustable by using a screw as shown in FIG. 11C or FIG. 12C, contact between cutting edge 9*a* of movable blade 9 and cutting edge 14*a* of fixed blade 14 can be optimized according to the thickness, width, and quality of the recording paper S, and can be adjusted to compensate for wear in the cutting edges of movable blade 9 and fixed blade 14. As a result, the straightness and the edge of the cut can be consistently maintained, and the service life of the cutter can be extended.

Note that in the scissors-type cutting apparatus described above the movable blade is supported by means of a stud disposed at the base of the movable blade to enable the movable blade to pivot, and a spring disposed on this stud pushes the movable blade against the fixed blade to cut the recording medium. While the force of coil spring 19 thus disposed is sufficient at the cutting start position near the stud 18, the operating force of coil spring 19 drops gradually along the length of the cutting edge and is weak at the cutting end position at the tip of the cutting edge.

More specifically, since movable blade 9 is shaped with a slight arc from the base to the tip thereof, the base section near stud 18 lifts up when the movable blade edge contacts the edge of fixed blade 14. The reactive force between the mounting member 9*b* end of movable blade 9 and the cutting position portion of movable blade 9 weakens the operating force of the spring as the cutting position approaches the free end of the movable blade 9, and the cutting performance of the blades deteriorates. This problem is resolved as described below in the present invention.

Figure 13:
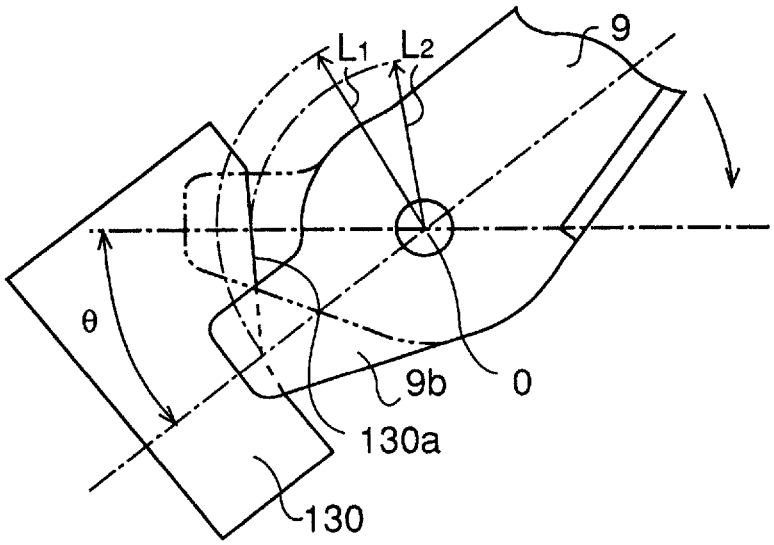
FIG. 13 illustrates the principle whereby the point of contact between the spacer and mount approaches the pivot stud as the movable blade rotates in a printer according to the present embodiment.

When spacer 130 is disposed between mounting member 9*b* of movable blade 9 and support base 30 as shown in FIG. 11A, spacer 130 is shaped as shown in FIG. 13, i.e., the part 130*a* of spacer 130 contacted by mounting member 9*b* when movable blade 9 rotates is angled toward stud 18 to provide a greater contact area with member 9*b* as movable blade 9 rotates.

More specifically, if the distance between the axis of rotation O of stud 18 and contact member 130*a* when movable blade 9 is in the standby position is L1, and L2 is the distance between axis of rotation O of stud 18 and contact member 130*a* when movable blade 9 rotates angle θ to the cutting end position, spacer 130 is formed to thickness t and angled so that L1>L2. As a result, the slope of mounting member 9*b* when movable blade 9 is in the standby position is /L1, the slope of mounting member 9*b* when movable blade 9 is fully rotated is t/L2, and the relative slope of cutting edge 9*a* of movable blade 9 increases with the rotation of movable blade 9.

With this configuration, rotation of movable blade 9 causes the slope of the blade to increase as the cutting point moves toward the tip of the blade, further compressing coil spring 19 and thus increasing the spring force. The decrease in the operating force is therefore reduced, and the cutting performance (edge) does not deteriorate.

Because it is also possible to suppress an unnecessary increase in the load on the cuttings edges of the fixed blade and movable blade, cutting edge wear is reduced, and the service life of the fixed blade and movable blade can thus be extended.

It should be noted that while the contact member 130*a* of spacer 130 contacted by mounting member 9*b* of movable blade 9 is shown as a straight member in FIG. 13, the present invention is not limited to such configuration. It will be obvious that contact member 130*a* of spacer 130 may be shaped as a curved member. This method of adjusting the operating force is also not limited to when spacer 130 is disposed between support base 30 and mounting member 9*b* of movable blade 9, and can obviously be adapted to the configuration shown in FIG. 12A in which a shoulder 30*b* is provided on support base 30.

Figure 14:
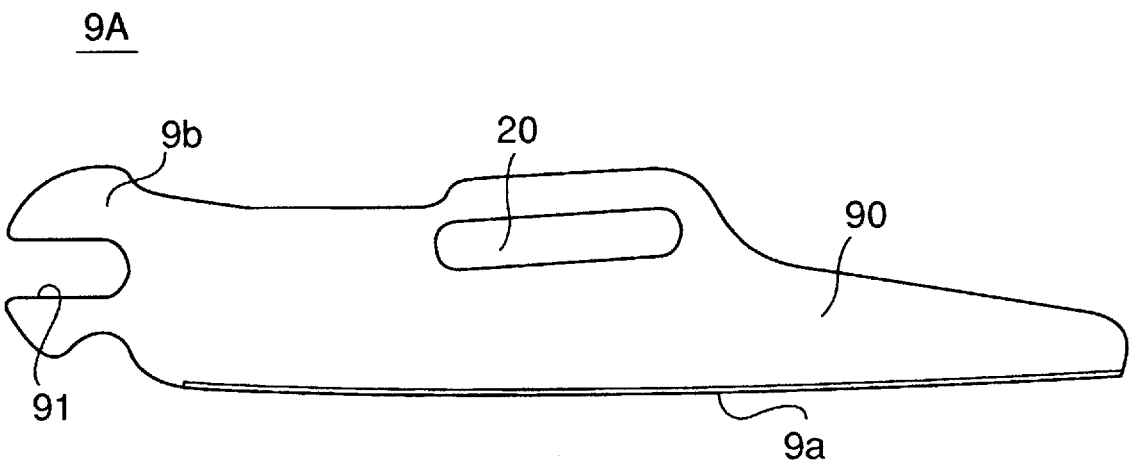
FIG. 14 is a plan view of another example of the movable blade.

An alternative embodiment of movable blade 9 is shown in FIG. 14. As shown in FIG. 14, a slot 91 for engaging stud 18 is disposed in mounting member 9*b* of this alternative movable blade 9A.

As described above, movable blade 9 is mounted to bottom 110 of lower frame 11*b* by inserting the hole formed in mounting member 9*b* over stud 18. When coil spring 19 is fastened to stud 18 using a push nut, however, it is difficult to remove the push nut and therefore difficult to replace movable blade 9.

However, if a slot 91 is provided in mounting member 9*b* as shown in FIG. 14, movable blade 9A can be easily removed and replaced. More specifically, coil spring 19 simply applies pressure to mounting member 9*b* of movable blade 9A and does not lock movable blade 9A in place. Movable blade 9A can therefore be easily pulled out and off stud 18, and a new movable blade 9A can be easily installed by simply fitting slot 91 to stud 18.

It should be noted that elongated hole 20 in movable blade 9A engages crank pin 24 when installed on the cutting apparatus, thus preventing movable blade 9A from accidentally coming out.

Figure 15:
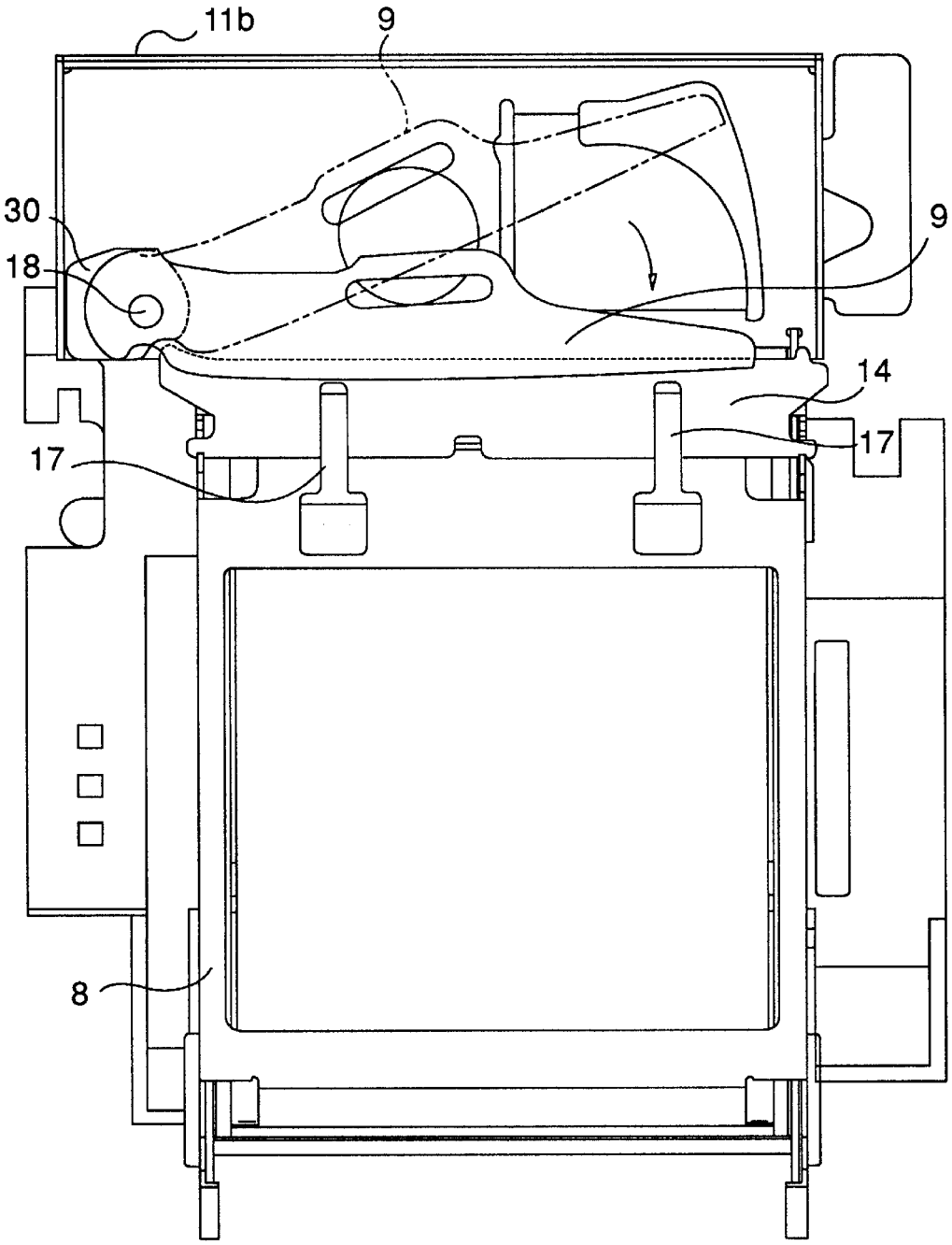
FIG. 15 is a plan view of the major components of the printer of FIG. 1 illustrating the movable blade in an irregular stop position.

It is also possible during printer 1 operation that a problem occurs causing movable blade 9 to stop in the middle of the cutting operation as shown in FIG. 15. By manually turning spur gear 29, which is exposed through upper frame 11*a* of cutter unit frame 11, fixed blade 14 can be moved back inside cutter unit frame 11. However, if movable blade 9 is not within the tolerance range of the standby position at this time, it will not be possible to close cover frame 8 because movable blade 9 will be riding on top of chamfer 14*e* of fixed blade 14.

Figure 16:
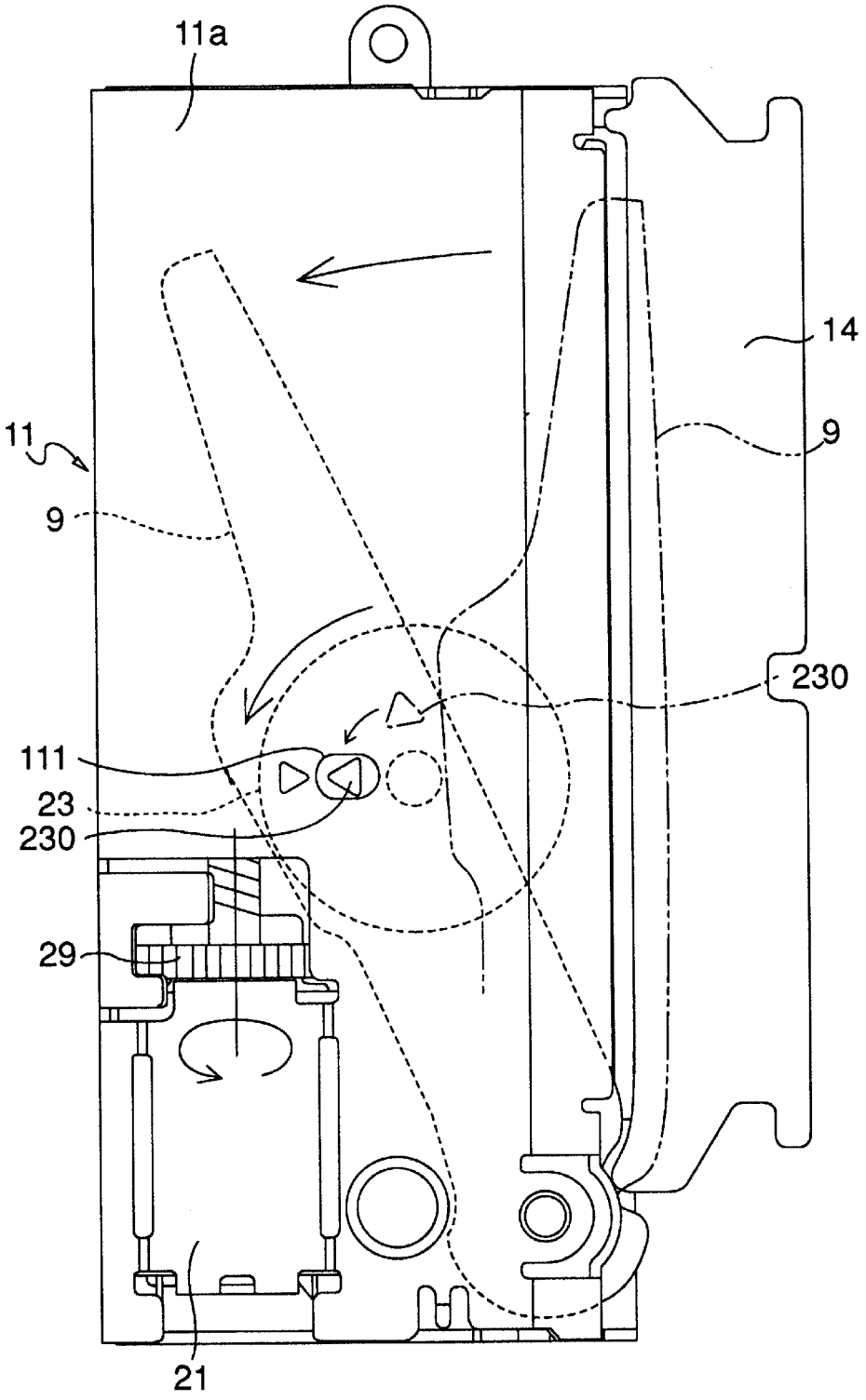
FIG. 16 is a plan view showing the index and window in a modification of the first embodiment.

Therefore, as shown in FIG. 16, the present embodiment is configured with window 111 in cover 11*a* of cutter unit frame 11 and a triangular index 230, for example, on the surface of worm wheel 23. Index 230 is disposed to be visible in window 111 when movable blade 9 is in the standby position. This configuration makes it simple to determine whether movable blade 9 has returned to the standby position by reading index 230 in window 111, and movable blade 9 can therefore be accurately returned to the home position.

If recording paper S is repeatedly cut by means of movable blade 9 and fixed blade 14 as described above, the tips of the blades will wear, becoming rounded and dull. To extend the service life of the movable blade 9 and fixed blade 14, the configuration described below can be used.

First, movable blade 9 and fixed blade 14 can be manufactured from materials with different hardness indices. In the preferred embodiments of the invention, movable blade 9 and fixed blade 14 are manufactured from stainless steel comparable to the SUS-420J2 stainless steel commonly used for stainless steel scissors by means of stamping, hardening and quenching, lapping, sharpening, and shaping, resulting in the hardness of movable blade 9 becoming greater than the hardness of fixed blade 14. For example, movable blade 9 is manufactured to a Rockwell hardness of HRC50 while fixed blade 14 is manufactured to a Rockwell hardness of HRC45.

Figure 17:
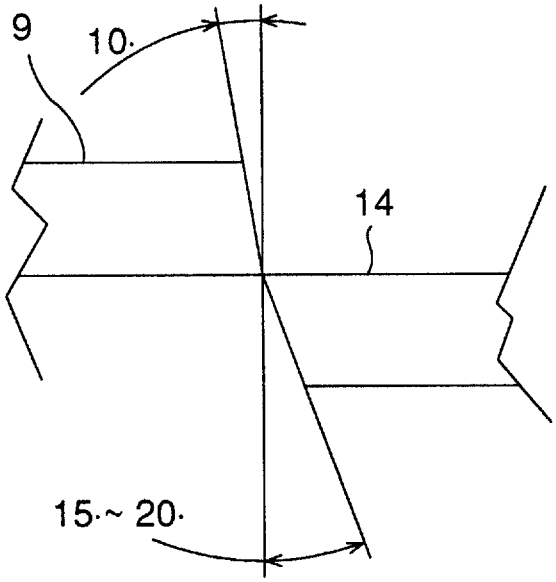
FIG. 17 illustrates the relationship between the cutting edge angles of the fixed blade and movable blade.

Second, fixed blade 14 is sharpened with the angle of the edge bevel greater than that of movable blade 9. For example, as shown in FIG. 17, the bevel angle of fixed blade 14 is set to approximately 15 to 20 degrees, and the bevel of movable blade 9 is set to about 10 degrees.

This design causes the cutting edge of fixed blade 14, which is softer and therefore wears more rapidly than movable blade 9, to wear while leaving a sharp cutting edge, thereby extending the effective service life of both movable blade 9 and fixed blade 14.

Note that fixed blade 14 is made softer to wear faster simply because it is easier to replace fixed blade 14 than movable blade 9. However, if movable blade 9A is manufactured with slot 91 as shown in FIG. 14, movable blade 9A can also be easily replaced and may therefore be manufactured to wear faster than fixed blade 14.

It should also be noted that because the means for cutting recording paper S, i.e., movable blade 9 and fixed blade 14, can be separated from each other at a distance in a non-cutting position in printer 1 according to the present invention, cutting edge 14*a* of fixed blade 14 is exposed when cover frame 8 is opened to, for example, replace recording paper S. Exposing the sharp cutting edge 14*a* of fixed blade 14 is obviously dangerous. To solve this problem, blade shutter 31 for covering cutting edge 14*a* of fixed blade 14 is disposed in printer 1 according to the present embodiment.

Figure 20:
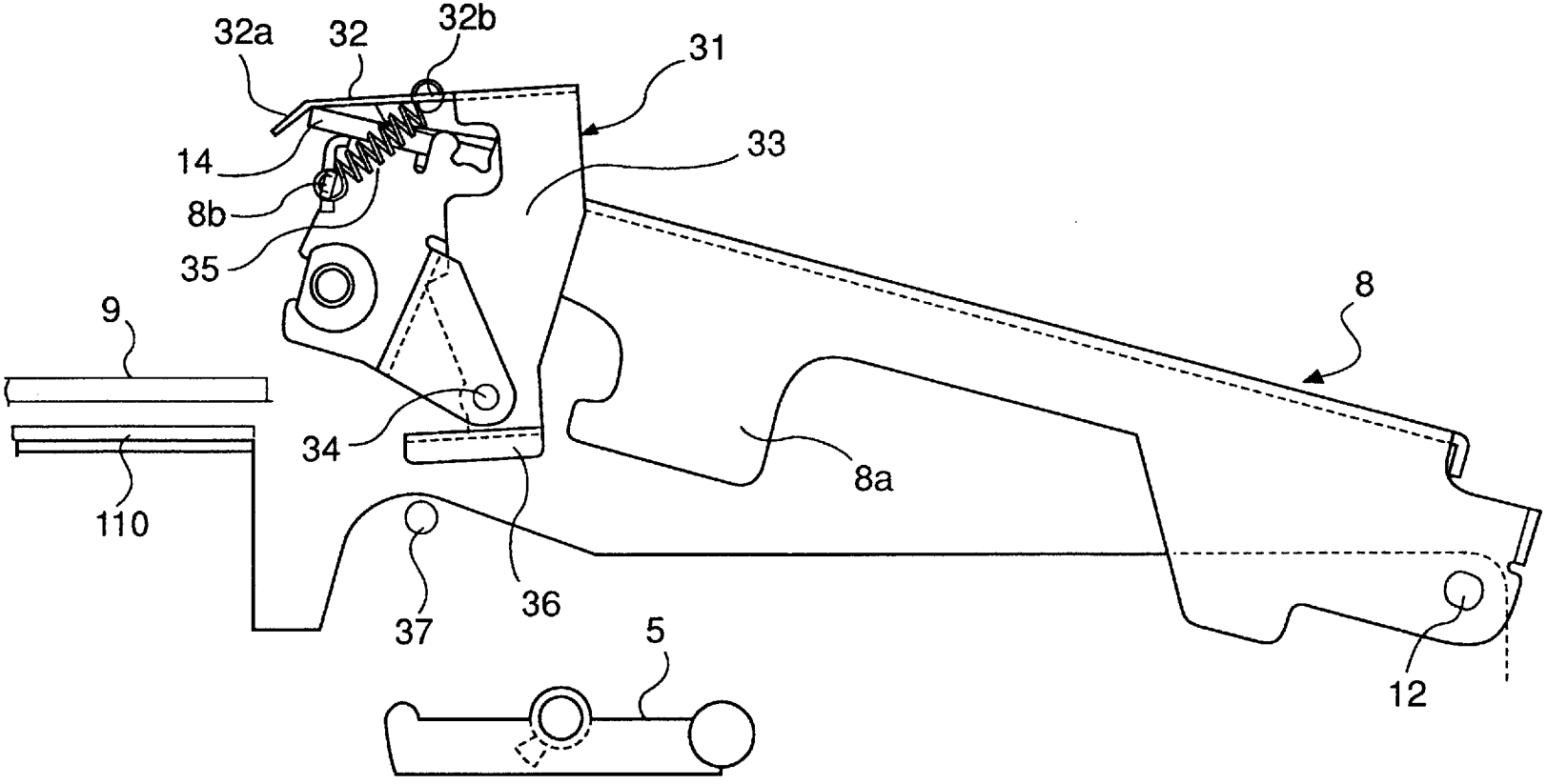
FIG. 20 is a side view of the major components when the cover frame is open in a printer according to the present invention.
Figure 21:
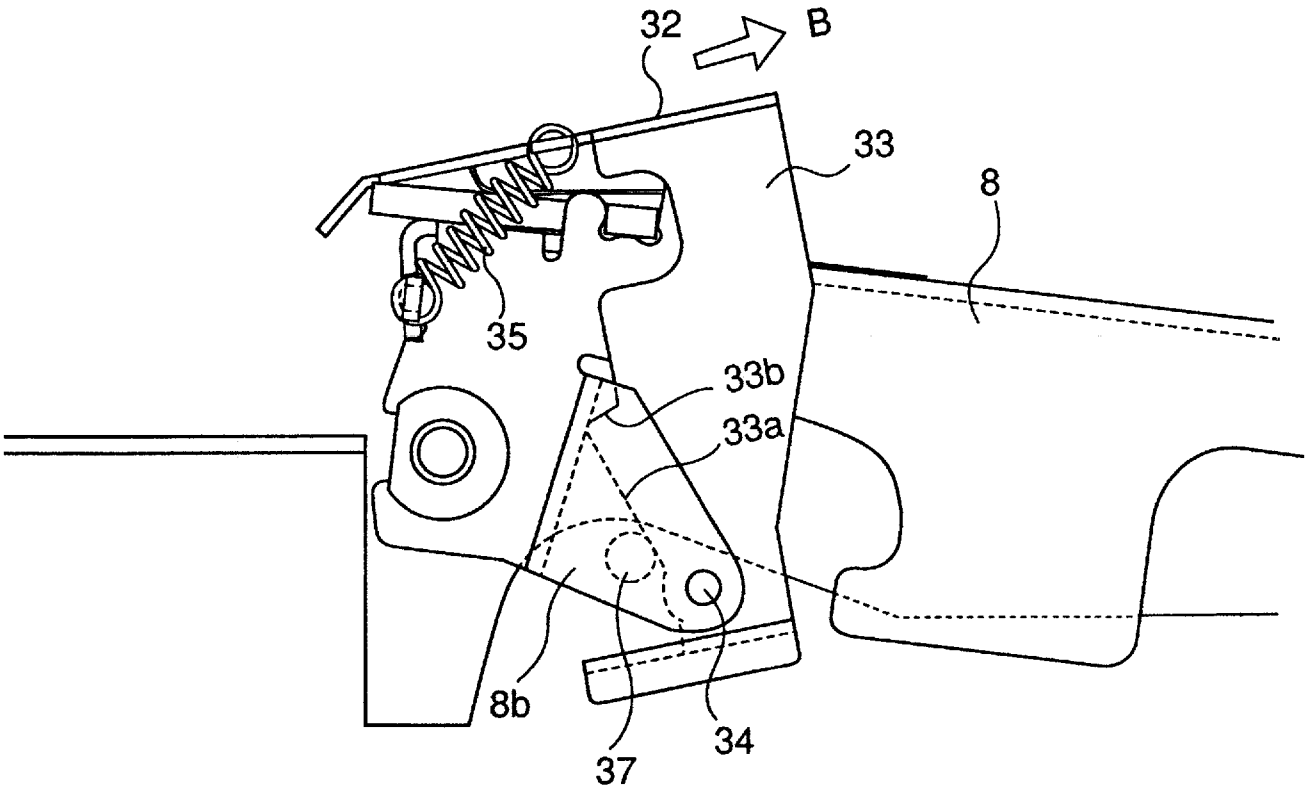
FIG. 21 is a side view of the major components when the cover frame is being closed in a printer according to the present invention.

FIGS. 20 and 21 show cover frame 8, supporting fixed blade 14, displaced about stud 12 to a non-cutting position in which fixed blade 14 and movable blade 9 are disposed at a distance from one another.

Figure 22:
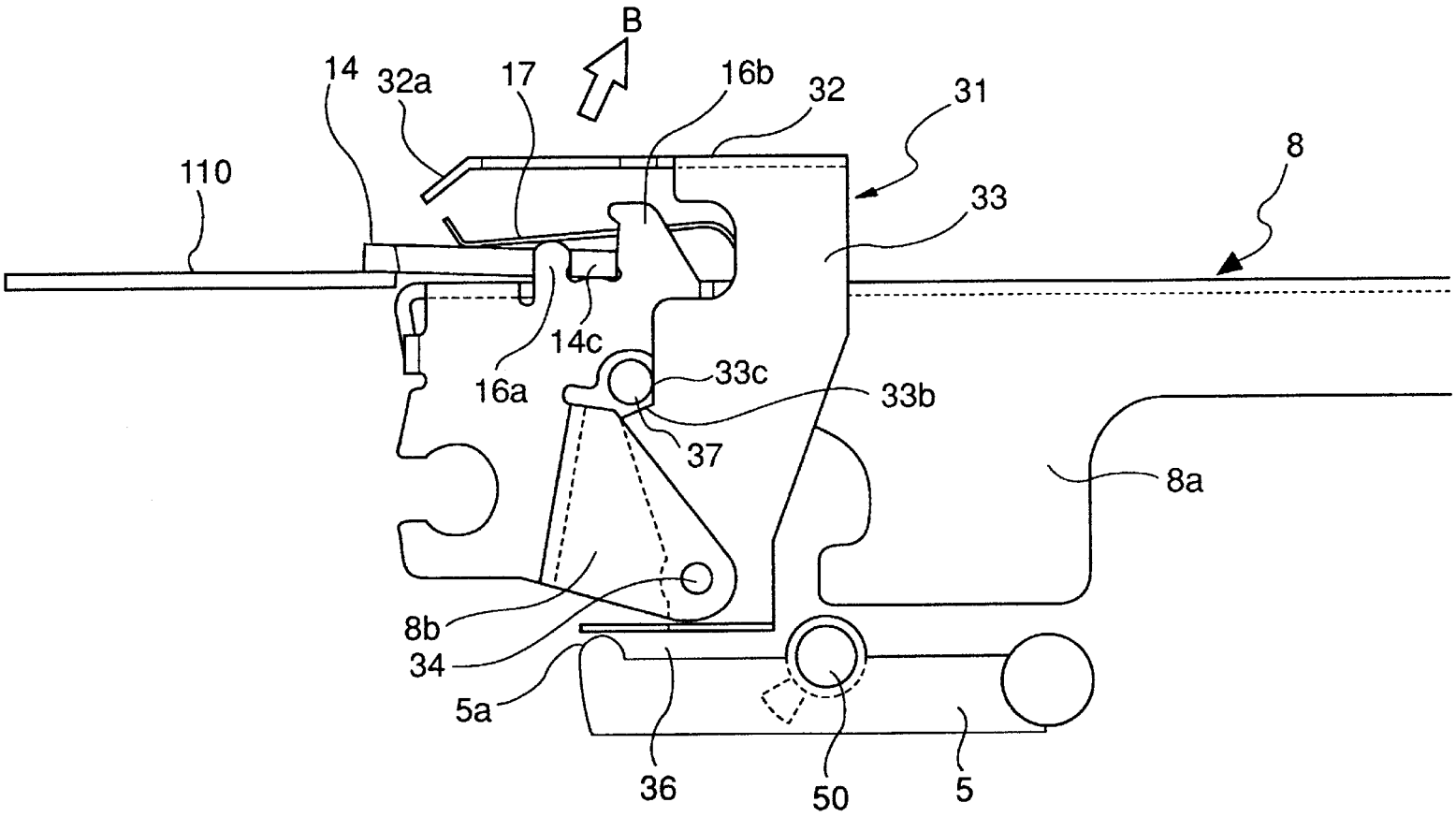
FIG. 22 is a side view of the major components when the cover frame is closed in a printer according to the present invention.

As shown in FIG. 20 to FIG. 22, blade shutter 31 in the present embodiment is manufactured from a metal U-channel, for example, and comprises shutter leaf 32 and a pair of arms 33. Note that shutter leaf 32 is slightly wider than cover frame 8, and the leading edge 32*a* of shutter leaf 32 is bent slightly downward towards fixed blade 14. The pair of arms 33 of blade shutter 31 straddle cover frame 8 with the ends of the arms fastened to support member 8*b* of cover frame 8. As a result, shutter leaf 32 is disposed to pivot freely on stud 34 in the direction perpendicular to the length of fixed blade 14, i.e., in the direction of arrow B in FIG. 21 and in the opposite direction.

As also shown in FIG. 20 and FIG. 21, coil spring 35 is disposed between support member 8*b* (hook) on the end of cover frame 8 and catch 32*b* of shutter leaf 32 of blade shutter 31. This coil spring 35 pulls blade shutter 31 toward movable blade 9 when cover frame 8 is opened. A link 36 that is operated by cover opening lever 5 is also disposed on the end of one arm 33 of blade shutter 31.

Engaging stud 37 for locking cover frame 8 is also provided on the side of case 4 to which cover opening lever 5 is disposed.

Note, as shown in FIG. 22, that cover opening lever 5 is configured to rock freely on stud 50 and stop at a position roughly parallel with the top of cover frame 8. An upward projection 5*a* is also disposed on one end of cover opening lever 5.

As a result of this configuration, blade shutter 31 is pulled toward movable blade 9 by means of coil spring 35 when cover frame 8 is opened as shown in FIG. 20 and FIG. 21. This causes leading edge 32*a* of shutter leaf 32 to contact and cover cutting edge 14*a* of fixed blade 14. This prevents the operator's fingers from contacting cutting edge 14*a* of fixed blade 14 when replacing recording paper S, for example, and thus improves the safety of printer 1.

When cover frame 8 is moved in the closing direction as shown in FIG. 21, leading end 33*a* of arm 33 of shutter leaf 32 contacts engaging stud 37 and rotates shutter leaf 32 in the direction of arrow B. As cover frame 8 is closed, link 36 engages projection 5*a* (FIG. 22) of the freely pivoting cover opening lever 5, and thus turns cover opening lever 5 as cover frame 8 closes.

Engaging stud 37 is also disengaged from leading end 33*a* when cover frame 8 is closed, thereby causing blade shutter 31 to pivot in the direction opposite arrow B until positioning piece 33*c* of blade shutter 31 is brought into contact with stud 37 by means of coil spring 35.

When this operation is completed, engaging member 33*b* is positioned below engaging stud 37 as shown in FIG. 22, cover opening lever 5 is stopped at a position roughly parallel with the top of cover frame 8, and cutting edge 14*a* of fixed blade 14 is exposed from leading edge 32*a* of shutter leaf 32 of the blade shutter 31. In FIG. 22, cover frame 8, supporting fixed blade 14, is displaced in the cutting position with fixed blade 14 and cutting blade 9 disposed in an adjacent, substantially facing relationship.

When cover frame 8 is closed, leading edge 32*a* of shutter leaf 32 of blade shutter 31 retracts from the transportation path of recording paper S, and does not contact recording paper S as it is advanced. As a result, it is possible to cut recording paper S using movable blade 9 and fixed blade 14 as described above.

However, to displace cover frame 8 to an open, non-cutting position cover opening button 6 is pressed as shown in FIG. 3 to rotate cover opening lever 5 clockwise. This causes projection 5*a* of cover opening lever 5 to push up on link 36 of blade shutter 31. Blade shutter 31 therefore pivots clockwise on stud 34, and engaging member 33*b* is released from beneath engaging stud 37.

When cover opening lever 5 is rotated further in the clockwise direction, link 36 of blade shutter 31 contacts and lifts support member 8*b* of cover frame 8, and thereby raises cover frame 8.

When impact, vibration, or other force tending to open cover frame 8 in the direction of arrow B is applied, engaging member 33*b* formed on blade shutter 31 contacts engaging stud 37, and this locking mechanism preventing the cover frame from pivoting upward protects cover frame 8 from opening freely.

By thus providing a member to cover the cutting edge of the blade as described above, any danger of being cut by a sharp edge when the cutting edge of the fixed blade is exposed can be avoided, and user safety is thus improved. This is particularly effective when the present invention is adapted to an automatic cutter using separable blades.

If a means for moving the blade cover in conjunction with the operation of the printer cover is provided when the present invention is adapted to an automatic cutter using separable knives, the cutting edge of the fixed blade will be automatically covered when the printer cover is opened. As a result, contact with the sharp cutting edge is effectively and reliably prevented even if the operator opens the cover to replace the recording paper S, for example, without being aware or careful of the cutting blades. A cutting apparatus that is extremely safe to use can therefore be provided.

An alternative embodiment of a printer according to the present invention is described below with reference to FIG. 23 and FIG. 24. Note that like parts in this embodiment and the preceding embodiments are identified with like references.

Figure 23:
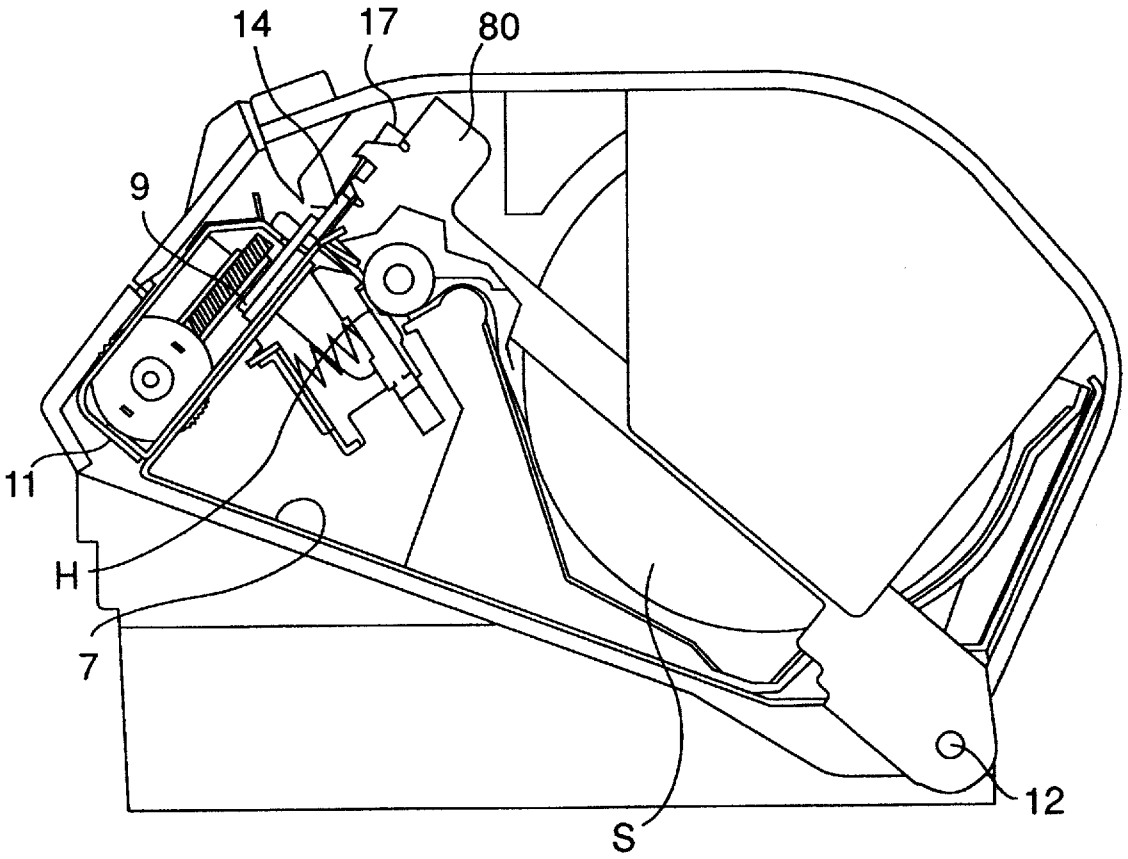
FIG. 23 is a side view showing the internal configuration of an alternative embodiment of a printer according to the present invention with the cover frame closed.
Figure 24:
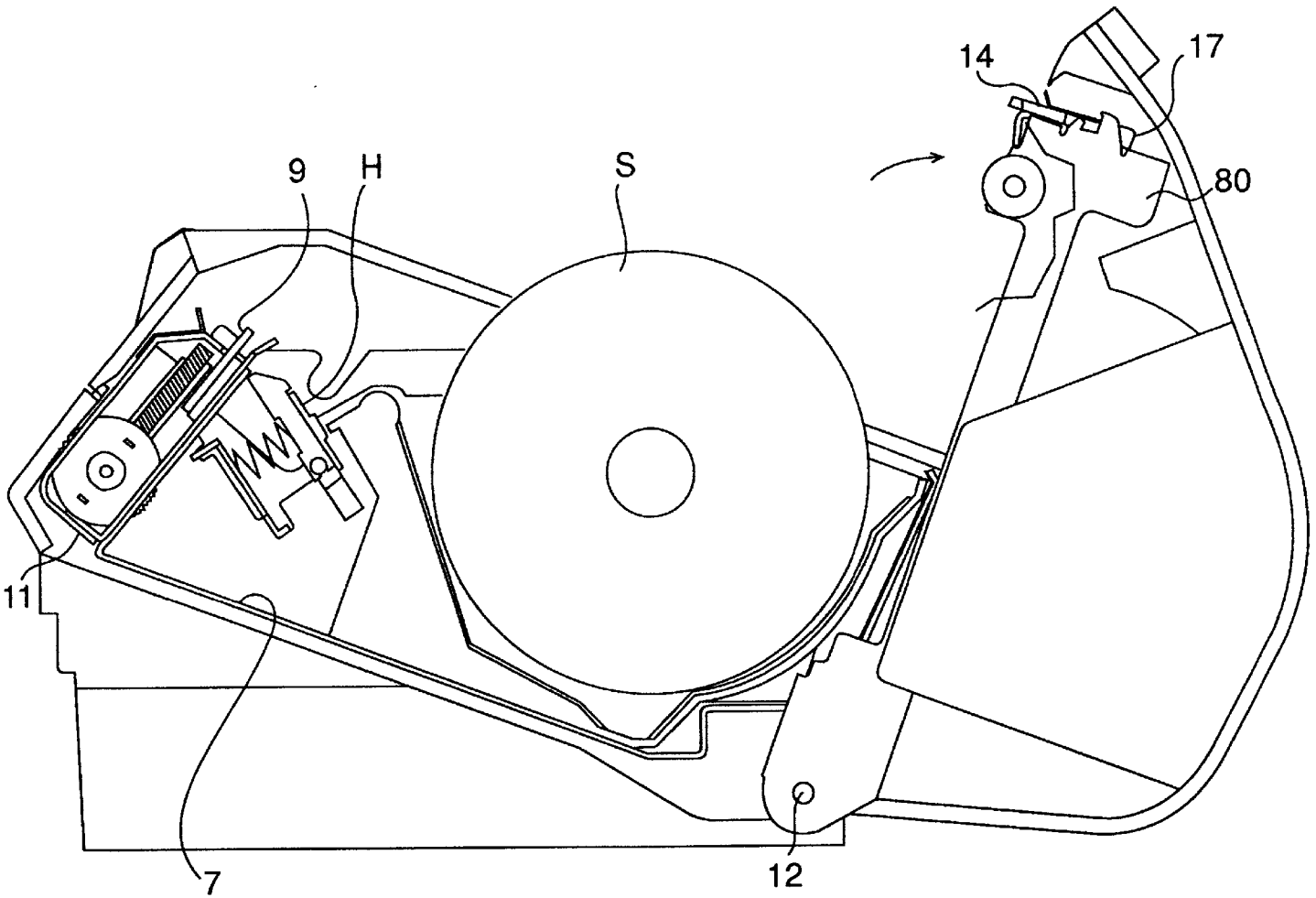
FIG. 24 is a side view showing the internal configuration of the FIG. 23 embodiment of a printer according to the present invention with the cover frame open.

As shown in FIG. 23 and FIG. 24, cutter unit frame 11 is disposed in front of main frame 7 as in the preceding embodiments, and cover frame 80 is mounted in a manner enabling cover frame 80 to pivot freely on studs 12. In the present embodiment, however, movable blade 9 and fixed blade 14 are provided in the same direction in which cover frame 80 opens. The relative positions between movable blade 9 and fixed blade 14 remain as described in the above embodiment, i.e., fixed blade 14 is on the upstream side in the direction of recording paper S transportation, and movable blade 9 is on the downstream side.

Note that movable blade 9 and fixed blade 14 are disposed perpendicularly to the direction in which cover frame 8 opens in the preceding embodiments. As a result, if the cutting operation is interrupted with movable blade 9 riding up on fixed blade 14 as shown in FIG. 15, cover frame 8 cannot be opened and applying excessive force to open cover frame 8 may break assembly components around movable blade 9 and fixed blade 14.

This problem is resolved in the present embodiment by disposing fixed blade 14 in the same direction in which cover frame 80 opens. As a result, cover frame 80 can be opened even if movable blade 9 is stopped while overlapping fixed blade 14, and damage to assembly components around movable blade 9 and fixed blade 14 can be prevented.

It should be noted that the present invention shall not be limited to the specific configurations described above, and various modifications are possible within the scope of the present invention.

For example, if the fixed blade and movable blade are configured to operate like scissors, a variety of other configurations are possible. For example, while the blades may be leaf-like members as described above, the body of the movable blade may alternatively be a round or square column-like member. Various other shapes of blades may also be used insofar as the cutting edges used to cut the recording paper contact at a point and slide relative to each other in a scissoring action to cut the recording medium.

The drive means used to drive the movable blade shall also not be limited to the drive motor and crank mechanism described above, and various other configurations are possible. Using the drive means described above does, however, make it possible to drive the movable blade by means of a simple design.

The positions at which the fixed blade and movable blade are disposed on opposite sides of the recording paper transportation path shall also not be limited to those described above. For instance, the movable blade may be mounted on the cover frame and the fixed blade on the main frame. However, by mounting the fixed blade on the cover frame and the movable blade above the printing unit, a simple configuration can be achieved.

The inclination of the movable blade can be slightly modified in this case, but the most effective angle of inclination is approximately one degree as described above.

The location and shape of the spacer may also be varied. The index mark provided on the worm wheel can also be disposed in various positions and shapes insofar as the index is visible when the movable blade is in the standby position.

The structure of the blade shutter covering the fixed blade can also be variously defined.

The blade shutter 31 covering the cutting edge of the exposed blade has been described in the preceding embodiment as effectively improving the safety of a motor-driven automatic paper cutter for cutting the recording paper, and particularly improving the safety of an automatic paper cutter comprising separable blades. This blade shutter mechanism shall not, however, be limited to a use in combination with such automatic paper cutters, and can also be applied to manual cutters in which a cutting blade is supported on an openable cover.

Furthermore, a printer comprising a cutting apparatus according to the present invention shall not be limited to printers using a roll-type recording medium, and can obviously be applied to a variety of other printer designs. However, the invention described above is a particularly effective means of simplifying the cutting apparatus design, and therefore reducing the size and cost of the cutting apparatus and, hence, printer, when applied in a printer that uses a roll-type recording medium.

The embodiments described above have also been described with reference to a printer comprising a thermal transfer recording head. The invention shall not be limited by the type of recording or printing head used, however, and can also be used, for example, with ink jet printers and dot impact printers using a wire dot print head.

The above embodiments are also described with the fixed blade mounted on a cover frame used as the blade support means and the movable blade on the main frame side. The invention shall not be so limited, however, and the movable blade can be mounted on the cover frame with the fixed blade disposed to the main frame.

The present invention provides a printer with a cutting apparatus with a high degree of design freedom, including the ability to deploy the cutting apparatus in a position whereby the recording medium need not be loaded through a narrow gap between the fixed blade and movable blade. The printer provides good cutting quality producing a clean cut, and producing minimal paper chaff from the recording medium. These advantages are achieved in the present invention by providing a pair of cutting blades, a fixed blade and a movable blade, supported independently on opposite sides of the recording medium, a blade support means for supporting the fixed blade or the movable blade in a manner whereby the cutting edge of the fixed blade can be disposed in proximity to the cutting edge of the movable blade in the cutting position and can be separated from the movable blade in a non-cutting position, and movable blade drive means for sliding the movable blade across the fixed blade in a scissors-like cutting action with the cutting edges of the two blades contacting at a single cutting point.

It is also possible to prevent variations in the feed pitch of the recording medium because the recording medium is not pulled during the cutting operation, unlike cutting apparatuses that cut by severing the recording medium with a cutting edge driven perpendicularly to the surface of the recording medium, and cutting apparatuses that cut using a fixed blade and rotary blade combination.

Recording medium jams between the fixed blade and movable blade can be prevented, and a high reliability printer can thus be achieved, by disposing the fixed blade on the upstream side and disposing the movable blade on the downstream side in the direction of the recording medium transportation path.

Installing and removing the fixed blade is also simplified and improved by using a configuration in which the fixed blade is forced by a flexible member against a support means, one side of which is open to allow installation and removal of the fixed blade.

Furthermore, by imparting a different hardness to the cutting edges of the fixed blade and movable blade, and setting the bevels of the cutting edges of the fixed blade and movable blade to different angles, dulling of the cutting edge on the blade that wears faster, i.e., the softer cutting edge, is slowed and the blade wears leaving a sharp cutting edge, and it is therefore not necessary to replace the blade as often. The effective service life of both the fixed blade and movable blade is therefore increased.

When a cutting blade is supported on an openable cover member as in the cutting apparatus described above, there is the danger of touching the blade when the cover is open. However, by providing a shield member covering the cutting edge, this danger is avoided even when the cover is opened, and user safety can therefore be improved.

By providing the fixed blade on the cover of the compartment in which the recording medium is stored and supporting the movable blade on the main frame in which the recording (print) assembly is disposed in a printer in which a cover is opened to replace the recording medium, it is not necessary to pass the recording medium through a narrow gap in the cutting apparatus, and it is therefore easier to load the recording medium. It is simultaneously possible to achieve a printer with a good cutting characteristic using a simple configuration.

It is also possible to achieve a printer having a safe cutting apparatus characterized by excellent linearity (straightness) in the cut edge, a consistent, stable cutting edge along all parts of both the fixed blade and movable blade, and excellent durability and ease of use.

As described above, the present invention achieves in a cutting apparatus and a printer comprising the cutting apparatus improved quality in the cut edge, improved reliability, improved ease of use, and lower cost.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printer comprising a recording medium cutting apparatus, said recording medium cutting apparatus comprising:

a pair of cutting blades including a fixed blade and a movable blade, and independent supports for supporting said fixed blade and said movable blade on opposite sides of a recording medium path;

said independent supports for supporting said fixed blade and said movable blade including a first blade support for supporting one of said fixed blade and said movable blade, and a second blade support for supporting the other of said fixed blade and said movable blade, and a swingable member for enabling displacement of said first blade support between a cutting position wherein said fixed blade and said movable blade are disposed in an adjacent, substantially facing relationship and a non-cutting position wherein said fixed blade and said movable blade are displaced at a distance from one another;

a movable blade driver for sliding said movable blade across said fixed blade when said movable blade and said fixed blade are disposed in said cutting position; and wherein one of said first and second blade supports comprises a fixed blade support member for supporting said fixed blade, and a pressure member for removably securing said fixed blade onto said fixed blade support member.

2. A printer according to claim 1 comprising a main frame and a pivot for fastening said swingable member to the main frame to enable said swingable member to rotate opened and closed;

said main frame comprising a compartment for the recording medium; and said swingable member comprising said first blade support and a cover for said recording medium compartment such that when said swingable member is closed said fixed blade and movable blade are disposed in said cutting position to cut the recording medium and when said swingable member is opened said recording medium compartment is opened.

3. A printer according to claim 2 wherein:

one of said first and second blade supports includes a movable blade support member for supporting said movable blade, a means for pivotally supporting said movable blade on said movable blade support member, and a contact member on said movable blade support member for contacting said fixed blade in said cutting position such that a sliding surface of said fixed blade and a sliding surface of said movable blade are positioned on substantially the same plane when said sliding surfaces contact in said cutting position.

4. A printer according to claim 1 further comprising a locking means for engaging and locking said first blade support in the cutting position.

5. A printer according to claim 1 wherein said movable blade travels in a first direction when cutting said recording medium and wherein said swingable member enables displacement of said fixed blade from said movable blade by moving initially in said first direction.

6. A printer according to claim 2 further comprising:

a shutter member pivotably supported on said first blade support for covering a cutting edge of one of said fixed blade and said movable blade;

a forcing means for forcing said shutter member into a position covering said one blade; and, means for retracting said shutter member from a transport path of the recording medium and from said position covering said one blade when in said cutting position.

7. The device according to claim 6 wherein said retracting means includes means responsive to a movement of said swingable member relative to said main frame for positioning said shutter member.

8. The device according to claim 7 wherein said shutter member is substantially U-shaped and comprises a plate member and two arm members, said arm members being pivotally supported about a pivot axis extending substantially in parallel to said one blade, said arm members being pivotable between a non-covering position in which said plate member is substantially parallel to said one blade leaving a cutting edge exposed, and a covering position in which said plate member is inclined with respect to said one blade with a part of the plate member extending across the cutting edge.

9. A printer according to claim 1 wherein said pressure member comprises at least one spring for pressing said fixed blade against said fixed blade support member.

10. A printer according to claim 1 further comprising at least one U-shaped support member for receiving a portion of said fixed blade.

11. A printer having a cutter for cutting a recording medium, said cutter comprising:

a fixed cutting blade and a movable cutting blade, disposed independently from each other on opposite sides of a recording medium path;

a blade support that supports one of the cutting blades movably between a first position at which the cutting blades are held in a cooperative condition opposite to each other and a second position at which the cutting blades are held in a non-cooperative condition remote from each other; and a driver that slides the movable blade against the fixed blade when the blades are at said first position; and wherein said blade support comprises a main frame supporting said movable cutting blade and a swingable member supporting said fixed cutting blade, said swingable member being mounted to the main frame to be pivotable between an opened position corresponding to said second position and a closed position corresponding to said first position; and wherein said main frame defines a recording medium compartment, and said swingable member comprises a cover to provide, in its opened position, access to said compartment allowing a supply of said recording medium to be filled in the compartment.

12. The printer according to claim 11 wherein said main frame supporting said movable blade comprises, at a position outside of said recording medium path on the side, a contact portion contacted by the fixed blade in said first position of the blades thereby causing a sliding surface of the fixed blade and a sliding surface of the movable blade to be positioned on substantially the same plane.

* * * * *